US007186097B1

(12) United States Patent
Blume

(10) Patent No.: US 7,186,097 B1
(45) Date of Patent: Mar. 6, 2007

(54) PLUNGER PUMP HOUSING AND ACCESS BORE PLUG

(76) Inventor: George H. Blume, 107 Morning Cloud Cove, Austin, TX (US) 78734

( * ) Notice: Subject to any disclaimer, the term of this patent is extended or adjusted under 35 U.S.C. 154(b) by 722 days.

(21) Appl. No.: 10/662,578

(22) Filed: Sep. 15, 2003

Related U.S. Application Data

(63) Continuation-in-part of application No. 10/288,706, filed on Nov. 6, 2002, now Pat. No. 6,623,259.

(51) Int. Cl.
*F04B 39/10* (2006.01)

(52) U.S. Cl. ..... 417/454; 417/571

(58) Field of Classification Search ..... 417/540, 417/559, 571, 454
See application file for complete search history.

(56) References Cited

U.S. PATENT DOCUMENTS 2,733,664 A * 2/1956 Saalfrank ..... 417/454
3,792,939 A * 2/1974 Zalis ..... 417/454
4,861,241 A * 8/1989 Gamboa et al. ..... 417/454
6,382,940 B1 * 5/2002 Blume ..... 417/571
6,544,012 B1 * 4/2003 Blume ..... 417/454
6,623,259 B1 * 9/2003 Blume ..... 417/454
6,910,871 B1 * 6/2005 Blume ..... 417/571

* cited by examiner

*Primary Examiner*—Michael Koczo, Jr.
(74) *Attorney, Agent, or Firm*—Dennis W. Gilstad

(57) ABSTRACT

Suction valve spring retainers mounted using an access bore plug are described for use in plunger pump housings having an offset access bore and incorporating structural features for stress-relief. These pump housing structural features accommodate access bore plugs that secure suction valve spring retainers that are internally located substantially centrally over the suction bore transition area of the plunger pump housing. Access bore plugs are secured in place on the pump housing using one or more threaded retainers. Plunger pumps so constructed are relatively resistant to fatigue failure because of stress-reducing structural features, and they may incorporate a variety of valve styles, including top and lower stem-guided valves and crow-foot-guided valves, in easily-maintained configurations. Suction valve spring retainers mounted in plunger pump housings may also incorporate a suction valve top stem guide. Further, certain structural features of access bore plugs may be dimensioned to aid in improving volumetric efficiency of the pumps in which they are used.

14 Claims, 23 Drawing Sheets

(Section B-B of Figure 17A)

(Section C-C of Figure 17A)

(Section D-D of Figure 17A)

(Section E-E of Figure 17A)

PLUNGER PUMP HOUSING AND ACCESS BORE PLUG

This is a continuation-in-part (CIP) of U.S. patent application Ser. No. 10/288,706, filed Nov. 6, 2002 now U.S. Pat. No. 6,623,259 as amended.

FIELD OF THE INVENTION

The invention relates generally to high-pressure plunger pumps used, for example, in oil field operations. More particularly, the invention relates to plunger pump housings that incorporate structural features for stress-relief and for accommodating valve spring retainers.

BACKGROUND

Engineers typically design high-pressure oil field plunger pumps in two sections; the (proximal) power section and the (distal) fluid section. The power section usually comprises a crankshaft, reduction gears, bearings, connecting rods, crossheads, crosshead extension rods, etc. Commonly used fluid sections usually comprise a plunger pump housing having a suction valve in a suction bore, a discharge valve in a discharge bore, an access bore, and a plunger in a plunger bore, plus high-pressure seals (including plunger packing), etc. FIG. 1 is a cross-sectional schematic view of a typical fluid section showing its connection to a power section by stay rods. A plurality of fluid sections similar to that illustrated in FIG. 1 may be combined, as suggested in the Triplex fluid section design schematically illustrated in FIG. 2.

Valve terminology varies according to the industry (e.g., pipeline or oil field service) in which the valve is used. In some applications, the term "valve" means just the moving element or valve body, whereas the term "valve" as used herein includes the valve body, the valve seat, one or more valve guides to control the motion of the valve body, and one or more valve springs that tend to hold the valve closed (i.e., with the valve body reversibly sealed against the valve seat).

Plunger pump housings are subject to fatigue due to stresses resulting from alternating high and low pressures which occur with each stroke of the plunger cycle. Plunger pump housings typically fail in areas of repetitive stress concentration. For example, fatigue cracks may develop in one of the areas defined by the intersecting suction, plunger, access and discharge bores as schematically illustrated in FIG. 3.

To reduce the likelihood of fatigue cracking in the high pressure plunger pump housings described above, a Y-block housing design has been proposed. The Y-block design, which is schematically illustrated in FIG. 4, reduces stress concentrations in a plunger pump housing such as that shown in FIG. 3 by increasing the angles of bore intersections above 90°. In the illustrated example of FIG. 4, the bore intersection angles are approximately 120°. A more complete cross-sectional view of a Y-block plunger pump fluid section is schematically illustrated in FIG. 5.

Although several variations of the Y-block design have been evaluated, none have become commercially successful for several reasons. One reason is that mechanics find field maintenance on Y-block fluid sections difficult. For example, replacement of plungers and/or plunger packing is significantly more complicated in Y-block designs than in the earlier designs represented by FIG. 1. In the earlier designs, provision is made to push the plunger distally through the cylinder bore and out through an access bore.

This operation, which would leave the plunger packing easily accessible from the proximal end of the plunger bore, is impossible in a Y-block design.

A brief review of plunger packing design will illustrate some of the problems associated with packing and plunger maintenance in Y-block fluid sections. FIG. 6 is an enlarged view of the packing in an earlier (but still currently used) fluid section such as that illustrated in FIG. 1. In FIG. 6, the packing and packing brass are installed in the packing box of the fluid section. Note that packing brass is a term used by field mechanics to describe bearing bronze, where the bronze has the appearance of brass.

In the fluid section portion schematically illustrated in FIG. 6, the packing box is an integral part of the fluid section housing; it may also be a separate unit bolted to the fluid section housing. The packing is retained, tightened and adjusted by turning the gland nut. Removing the gland nut, however, does not allow one to remove the packing rings. Because packing rings must block high-pressure fluid leakage past the plunger, they are typically quite stiff, and they remain substantially inaccessible while the plunger (or any piece of it) remains in the plunger bore. FIG. 7 schematically illustrates portions of a plunger pump housing such as that shown in FIG. 5, with components including a gland nut and plunger parts. Note that the distal end of the plunger (i.e., the pressure end) is within the packing box. Note also that the plunger pressure end cannot be rotated for removal until it clears the packing brass. This illustrates the necessity for a two-piece plunger in which the two pieces must be separated as they are individually removed from the plunger bore.

The necessity for a multi-piece plunger in Y-block fluid section housings has not been eliminated by the recent introduction of packing assemblies such as those called "cartridge packing" by UTEX Industries in Houston, Tex. An example of such cartridge packing is schematically illustrated in FIG. 8. Note that removal of the gland nut exposes the packing cartridge housing, which in turn may be fitted with attachment means to allow extraction of the packing cartridge from the packing box (requiring proximal travel of the packing cartridge housing of approximately three to five inches).

This extraction, though, is not practical while a plunger piece lies within the packing box because of the excessive drag of the compressed packing rings on the plunger and packing box walls. Such compression can not be released unless all plunger pieces are removed from the packing box because the packing rings in the above cartridge packing assemblies are pre-compressed when the assemblies are manufactured. Further, any slight misalignment of apparatus used to extract such a cartridge packing assembly tends to cause binding of the (right cylindrical, i.e., not tapered) packing assembly within the (right cylindrical) bore in which it is installed. Analogous difficulties occur if an attempt is made to replace such a cartridge packing assembly while a plunger or part thereof lies in the packing box area. Hence, even if such cartridge packing assemblies were used in Y-block fluid section housings, multi-piece plungers would preferably be used and field maintenance would be correspondingly complicated and expensive.

Thus the Y-block configuration, while reducing stress in a plunger pump housing relative to earlier designs, is associated with significant disadvantages. However, new high pressure plunger pump housings that provide both improved internal access and superior stress reduction are described in copending U.S. patent application Ser. No. 10/288,706, as amended (hereinafter the '706 application), of which the present application is a continuation-in-part. FIG. 9 is a schematic illustration showing examples of structural features disclosed in the '706 application. It includes a right-angular plunger pump housing comprising a suction valve bore (suction bore), discharge valve bore (discharge bore), plunger bore and access bore. The suction and discharge bores each have a portion with substantially circular cross-sections for accommodating a valve body and valve seat with substantially circular cross-sections. Note that the illustrated portions of the suction and discharge bores that accommodate a valve seat are slightly conical to facilitate substantially leak-proof and secure placement of each valve seat in the pump housing (e.g., by press-fitting). Less commonly, the portions of suction and discharge bores intended to accommodate a valve seat are cylindrical instead of being slightly conical. Further, each bore (i.e., suction, discharge, access and plunger bores) comprises a transition area for interfacing with other bores.

The plunger bore of the right-angular plunger pump housing of FIG. 9 comprises a proximal packing area (i.e., an area relatively nearer the power section) and a distal transition area (i.e., an area relatively more distant from the power section) plus a central area between the proximal packing area and the transition area. The proximal packing area comprises a tapered portion for accommodating a corresponding tapered cartridge packing assembly and a threaded portion for accommodating threads of a gland nut. The transition area of the plunger bore facilitates bore interfaces (i.e., reduces stress at bore intersections) at analogous transition areas of other bores as noted above.

Each bore transition area of the right-angular pump housing of FIG. 9 has a stress-reducing feature comprising an elongated (e.g., elliptical or oblong) transverse cross-section having a relatively longer major axis and a (perpendicular) relatively shorter minor axis. Each such cross-section major axis is substantially perpendicular to its respective bore's longitudinal axis and is also perpendicular to a plane that contains (or is parallel to) the longitudinal axes of the suction, discharge, access and plunger bores. Intersections of the bore transition areas are chamfered, the chamfers comprising additional stress-reducing features.

An elongated suction bore transition area, as described in the '706 application, can simplify certain plunger pump housing structural features needed for installation of a suction valve (including its valve spring and valve spring retainer). Specifically, the valve spring retainer of a suction valve installed in such a plunger pump housing does not require a retainer arm projecting from the housing. Nor do threads have to be cut in the housing to position the retainer that secures the suction valve seat. Benefits arising from the absence of a suction valve spring retainer arm include stress reduction in the plunger pump housing and simplified machining requirements. Further, the absence of threads associated with a suction valve seat retainer in the suction bore eliminates the stress-concentrating effects that would otherwise be associated with such threads.

Threads can be eliminated from the suction bore if the suction valve seat is inserted through the suction bore transition area and press-fit into place as described in the '706 application. Following this, the suction valve body can also be inserted through the suction bore transition area. Finally, a valve spring is inserted via the suction bore transition area and held in place by an oblong suction valve spring retainer, an example of which is described in the '706 application and illustrated in FIG. 9. Note that the '706 application illustrates an oblong suction valve spring retainer having a guide hole (for a top-stem-guided valve body), as well as an oblong suction valve spring retainer without a guide hole (for a crow-foot-guided valve body) as shown in FIG. 9. Both of these oblong spring retainer embodiments are secured in a pump housing of the '706 application by clamping about an oblong lip, the lip being a structural feature of the housing (see FIG. 9).

The '706 application also shows how stem-guided valves can be mounted in the fluid end of a high-pressure pump incorporating positive displacement pistons or plungers. This configuration contrasts with conventional well service pumps having both suction and discharge valves that typically incorporate a traditional full open seat design with each valve body having integral crow-foot guides. Crow-foot-guided valves have been found tolerant of the high pressures and repetitive impact loading experienced by valve bodies and valve seats used in well service. But stem-guided valves with full open seats could also be considered for well service because they offer better flow characteristics than traditional crow-foot-guided valves. Stem-guided valves have not been more widely adopted for such use in part because, in a full open seat configuration, stem-guided valves require guide stems on both sides of the valve body (i.e., "top" and "lower" guide stems) to maintain proper alignment of the valve body with the valve seat during opening and closing. Unfortunately, designs incorporating secure placement of guides for both top and lower valve guide stems of suction valves have, before improvements described in the '706 application, been associated with complex components and difficult maintenance.

SUMMARY OF THE INVENTION

The current invention includes methods and apparatus related to suction valve spring retainers and to plunger pump housings in which they are used. Typically, such plunger pump housings incorporate one or more of the stress-relief structural features described herein, plus one or more additional structural features, such as an offset access bore, associated with use of certain valve spring retainers in the housings. Additionally, such plunger pump housings may incorporate structural features associated with use of tapered cartridge packing assemblies.

Examples of plunger pump housings of the present invention include substantially right-angular plunger pump housings having substantially in-line (i.e., opposing) suction and discharge bores whose centerlines are substantially colinear and at substantially right angles to the centerlines of the plunger and access bores. Plunger and access bores of such housings have centerlines that are substantially coplanar with the suction and discharge bore centerlines, but the plunger and access bore centerlines are non-colinear. Rather, the access bore centerline is substantially parallel to the plunger bore centerline and displaced a predetermined distance from the plunger bore centerline toward the suction bore.

Where indicated herein as being parallel, perpendicular, colinear and/or coplanar, bore centerlines (or longitudinal axes) may vary somewhat from these precise conditions, due for example to manufacturing tolerances, while still substantially reflecting advantageous structural features of the present invention. The occurrence of such variations in certain manufacturing practices means, for example, that plunger pump housing embodiments of the present invention may vary somewhat from a precise right-angular configuration. Such plunger pump housings substantially reflect advantageous structural features of the present invention notwithstanding angles between the centerlines or longitudinal axes of adjacent bores that are within a range from approximately 85 degrees to approximately 95 degrees. Where the lines and/or axes forming the sides of such an angle to be measured are not precisely coplanar, the angle measurement is conveniently approximated using projections of the indicated lines and/or axes on a single plane in which the projected angle to be approximated is maximized.

Illustrated embodiments of the present invention include, for example, a plunger pump housing with offset access bore, the plunger pump housing comprising a suction valve bore having a portion with substantially circular transverse cross-sections for accommodating a circular suction valve, a transition area for facilitating bore interfaces, and a first centerline. The plunger pump housing also comprises a discharge valve bore having a portion with substantially circular transverse cross-sections for accommodating a circular discharge valve, a transition area for facilitating bore interfaces, and a second centerline, said first and second centerlines being colinear. The plunger pump housing further comprises a plunger bore having a proximal packing area, a distal transition area for facilitating bore interfaces, and a central area between said packing area and said transition area. The central area has a substantially circular transverse cross-section with a central area diameter and a third centerline, and the third centerline is coplanar with the first and second centerlines. And the plunger pump housing still further comprises an offset access bore having a cylindrical (i.e., non-tapered) portion having an oblong transverse cross-section for accommodating (with a close sliding fit) an access bore plug. The offset access bore also has a transition area extending longitudinally from its cylindrical portion for facilitating bore interfaces. The cylindrical portion of the offset access bore has a fourth centerline that is coplanar with the first, second and third centerlines and parallel to the third centerline. And the fourth centerline is spaced a predetermined (offset) distance apart from the third centerline toward the suction valve bore.

In the above plunger pump housing with offset access bore, the suction valve bore transition area has elongated transverse cross-sections substantially perpendicular to the first centerline. And each such suction valve bore elongated cross-section has a major (i.e., long) axis substantially perpendicular to a plane containing the first, second, third and fourth centerlines. Further, the discharge valve bore transition area has elongated transverse cross-sections substantially perpendicular to the second centerline. And each such discharge valve bore elongated transverse cross-section has a major axis substantially perpendicular to a plane containing the first, second, third and fourth centerlines. Still further, the plunger bore transition area has elongated cross-sections substantially perpendicular to the third centerline. And each such plunger bore elongated cross-section has a major axis substantially perpendicular to a plane containing the first, second, third and fourth centerlines. Finally, both the offset access bore cylindrical portion and the offset access bore transition area have elongated transverse cross-sections substantially perpendicular to the fourth centerline. And each such access bore elongated cross-section has a major axis substantially perpendicular to a plane containing the first, second, third and fourth centerlines.

In the illustrated embodiment of the above plunger pump housing with offset access bore, the second and third centerlines form an angle within a range from approximately 85 degrees to approximately 95 degrees, and the predetermined (offset) distance between the third and fourth centerlines is between about 2% and about 20% of said central area diameter. Further, the plunger bore proximal packing area comprises a tapered portion for accommodating a corresponding tapered cartridge packing assembly, the packing area having substantially circular transverse cross-sections and a centerline colinear with the third centerline. The suction bore transition area, discharge bore transition area, plunger bore transition area and access bore transition area each have at least one adjacent chamfer for smoothing bore interfaces.

Also schematically illustrated herein are embodiments of an access bore plug for a plunger pump housing having an offset access bore. The access bore plug comprises a flange for securing the access bore plug to the plunger pump housing (e.g., with a threaded retainer) and the flange has a longitudinal axis perpendicular to the plane of the flange. A cylindrical portion of the access bore plug extends longitudinally from the flange, the cylindrical portion having an elongated transverse cross-section which itself has a major axis and a perpendicular minor (i.e., short) axis. The cylindrical portion extends longitudinally from the flange sufficiently to slidingly and sealingly fit within a corresponding offset access bore cylindrical portion in the plunger pump housing.

At least one suction valve spring retainer support extends longitudinally from the cylindrical portion of the above access bore plug for securing a suction valve spring retainer mounting bracket in a position aligned with a perpendicular to a minor axis of a transverse cross-section of the cylindrical portion. When the access bore plug's cylindrical portion is fully inserted into the access bore's cylindrical portion (i.e., so that the plug's flange contacts the plunger pump housing), this perpendicular, being parallel to the flange's longitudinal axis, is thus also parallel to the fourth centerline (i.e., the access bore's centerline). This perpendicular is also spaced sufficiently apart from the fourth centerline so that when the access bore plug is fully inserted as above, the suction valve spring retainer mounting bracket is in a position that is spaced longitudinally apart from the access bore plug's cylindrical portion and is also substantially centrally located over the suction bore transition area in the plunger pump housing. As noted above, the suction valve spring retainer mounting bracket is secured in this position by being supported by at least one suction valve spring retainer support arm.

Note also that the suction valve spring retainer mounting bracket and each suction valve spring retainer support comprises an inner surface, each inner surface generally conforming to a cylindrical envelope and being slightly spaced apart from the cylindrical envelope. The cylindrical envelope encompasses that space that would be cyclically occupied by a plunger during the plunger's (reciprocating) pumping movement in a plunger bore of the plunger pump housing in which the access bore plug may be secured. This spacing between inner surfaces and the cylindrical envelope allows the plunger's reciprocating (cyclic) motion to take place within the pump housing without interference due to striking a suction valve spring retainer mounting bracket or a suction valve spring retainer support arm.

Alternative embodiments of the present invention are disclosed herein with reference to appropriate drawings.

DETAILED DESCRIPTION OF ILLUSTRATED EMBODIMENTS

Figure 10C:
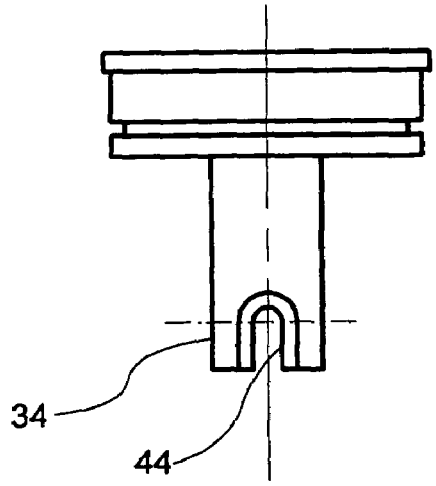
FIG. 10C schematically illustrates an elevation of the access bore plug shown in FIG. 10A.
Figure 10B:
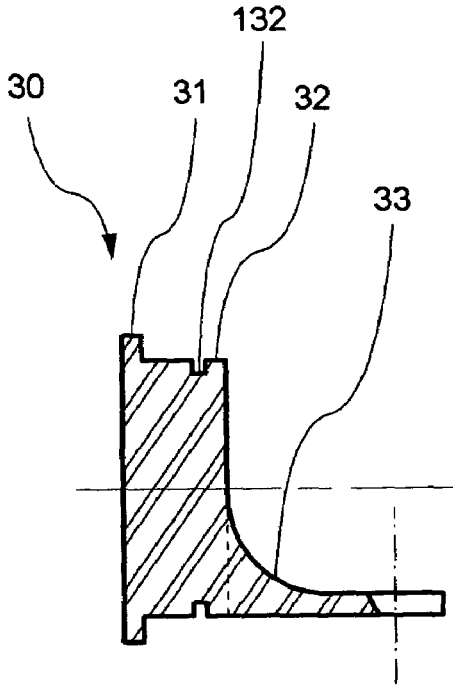
FIG. 10B schematically illustrates the section B—B indicated in FIG. 10A.
Figure 10A:
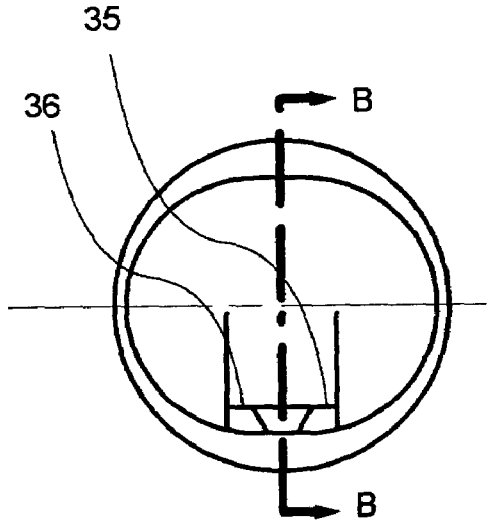
FIG. 10A schematically illustrates a plan view of an access bore plug for a plunger pump housing having an offset access bore, the access bore plug having a single suction valve spring retainer support securing a slotted suction valve spring retainer.
Figure 13:
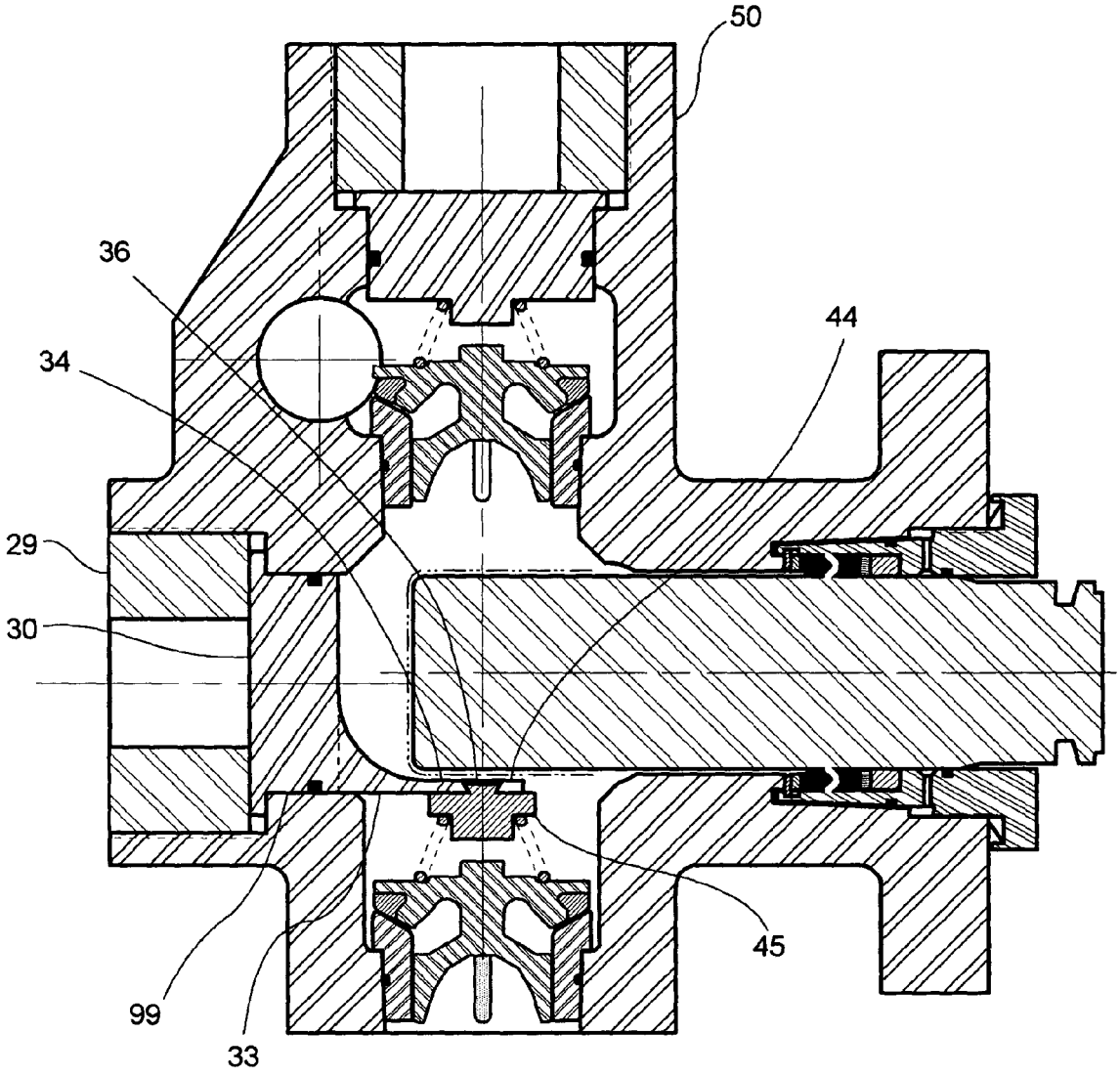
FIG. 13 schematically illustrates a right-angular plunger pump housing with an offset access bore, including suction and discharge valves, an access bore plug similar to that shown in FIGS. 10A, 10B and 10C, and a tapered cartridge packing assembly similar to that shown in FIG. 12A. Note the presence of a spring retainer slidingly positioned in the suction valve spring retainer mounting bracket's longitudinal slot.

FIGS. 10A, 10B and 10C schematically illustrate three views of an access bore plug 30 of the present invention, intended for use in a plunger pump housing 50 having an offset access bore (as in, for example, FIG. 13). As seen in FIG. 10A, the elongated transverse cross-section of cylindrical portion 32 has a major axis (shown horizontal in FIG. 10A) and a perpendicular minor axis (shown vertical in FIG. 10A). Access bore plug features shown in FIGS. 10A, 10B and 10C include a flange 31 for securing the bore plug to plunger pump housing 50 using a threaded bore plug retainer 29 (see FIG. 13). A cylindrical portion 32 having a seal groove 132 extends longitudinally from flange 31, cylindrical portion 32 having an elongated transverse cross-section and extending longitudinally from said flange 31 sufficiently to slidingly and sealingly fit within a corresponding offset access bore cylindrical portion 99 in the plunger pump housing (see FIG. 13). Such a sliding and sealing fit within offset access bore cylindrical portion 99 may be facilitated by seal means such as a seal in seal groove 132 (as schematically illustrated in FIG. 13). Alternative seal means for providing the desired sliding and sealing fit (including, for example, use of seals in multiple and/or differently shaped seal grooves) are well known to those skilled in the art.

A suction valve spring retainer support arm 33 extends longitudinally from cylindrical portion 32 of access bore plug 30 for securing a suction valve spring retainer mounting bracket 34 comprising longitudinal slot 44 in a position aligned with a perpendicular to a minor axis of a transverse cross-section of cylindrical portion 32. As shown in FIG. 13, this perpendicular is parallel to the access bore centerline when access bore plug 30 is inserted in plunger pump housing 50. Mounting bracket 34 is thus spaced apart from cylindrical portion 32 (see FIGS. 10A and 10B). When access bore plug 30 is fully inserted in plunger pump housing 50 (as in FIG. 13), the position in which suction valve spring retainer mounting bracket 34 is secured within plunger pump housing 50 is substantially centrally located over the suction bore transition area. Note that suction valve spring retainer mounting bracket 34 may be secured to suction valve spring retainer support arm 33 by any of the methods known to those skilled in the art (e.g., by welding), or suction valve spring retainer mounting bracket 34 may be secured to suction valve spring retainer support arm 33 by being formed integrally with it (e.g., by forging).

Referring to FIGS. 10A, 10B and 10C, note also that suction valve spring retainer mounting bracket 34 and suction valve spring retainer support arm 33 comprise inner surfaces 35 and 36 respectively. Each of the inner surfaces 35 and 36 generally conforms to a cylindrical envelope and is slightly spaced apart from the cylindrical envelope. This cylindrical envelope is schematically illustrated by a broken line around the distal end of the plunger in FIG. 13. The cylindrical envelope encompasses that space that would be cyclically occupied by a plunger's pumping movement in a plunger bore of plunger pump housing 50 in which access bore plug 30 may be secured. This envelope is represented as closely approximating the surface of the plunger as shown in FIG. 13 because the plunger is shown at the distal end of its normal cyclic travel into pump housing 50. The slight spacing between the envelope and inner surface 35 of suction valve spring retainer mounting bracket 34 and inner surface 36 of suction valve spring retainer support arm 33 respectively ensures that during its normal reciprocating motion in plunger pump housing 50, the plunger will not interfere with (i.e., contact) either suction valve spring retainer mounting bracket 34 or suction valve spring retainer support arm 33.

Figure 11C:
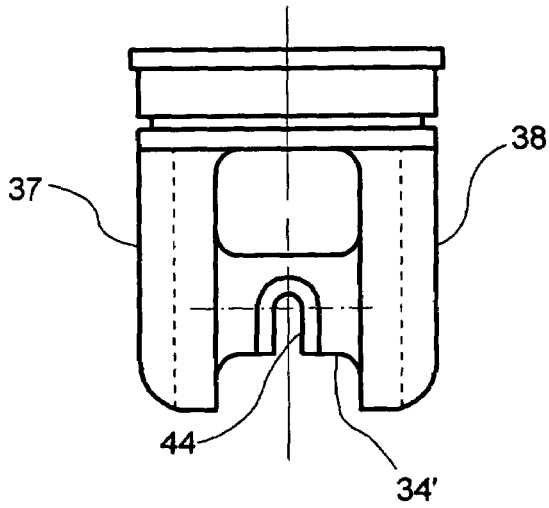
FIG. 11C schematically illustrates an elevation of the access bore plug shown in FIG. 11A.

In a manner analogous to that described above for access bore plug 30, FIGS. 11A, 11B and 11C schematically illustrate three views of an access bore plug 30' of the present invention. Like access bore plug 30, access bore plug 30' is intended for use in a plunger pump housing 50 having an offset access bore (as seen in, for example, FIG. 14). Access bore plug features shown in FIGS. 11A, 11B and 11C include a flange 31 for securing the bore plug to plunger pump housing 50 using a threaded bore plug retainer 29 (see FIG. 14). A cylindrical portion 32 having a seal groove 132 extends longitudinally from flange 31, cylindrical portion 32 having an elongated transverse cross-section and extending longitudinally from flange 31 sufficiently to slidingly and sealingly fit within a corresponding offset access bore cylindrical portion 99 in the plunger pump housing (see FIG. 14). As seen in FIG. 11A, the elongated transverse cross-section of cylindrical portion 32 has a major axis (shown horizontal in FIG. 11A) and a perpendicular minor axis (shown vertical in FIG. 11A).

Figure 11B:
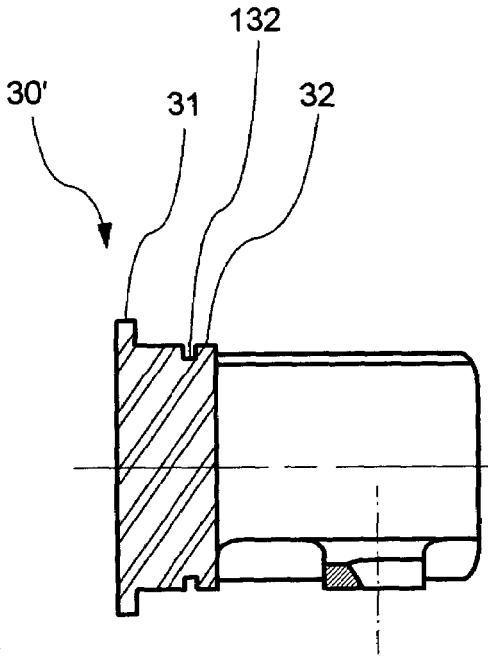
FIG. 11B schematically illustrates the section B—B indicated in FIG. 11A.
Figure 11A:
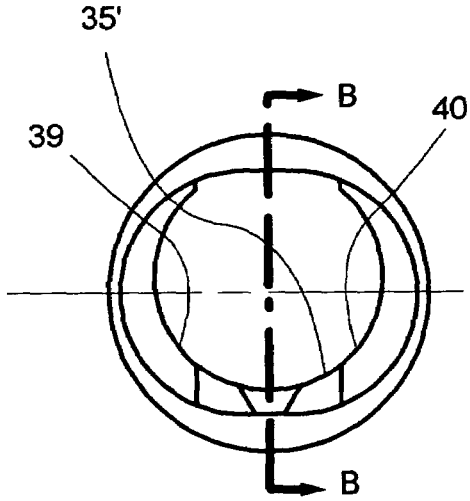
FIG. 11A schematically illustrates an access bore plug for a plunger pump housing having an offset access bore, the access bore plug having paired suction valve spring retainer supports securing a slotted suction valve spring retainer.

Paired suction valve spring retainer support arms 37 and 38 extend longitudinally from cylindrical portion 32 of access bore plug 30' for securing a suction valve spring retainer mounting bracket 34' having a longitudinal slot 44 in a position aligned with a perpendicular to a minor axis of a transverse cross-section of cylindrical portion 32 and spaced apart from cylindrical portion 32 (see FIGS. 11A and 11B). The position in which suction valve spring retainer mounting bracket 34' is secured within plunger pump housing 50 is substantially centrally located over a suction bore transition area (see FIG. 14). Note that suction valve spring retainer mounting bracket 34' may be secured to paired suction valve spring retainer support arms 37 and 38 by any of the methods known to those skilled in the art (e.g., by welding), or suction valve spring retainer mounting bracket 34' may be secured to paired suction valve spring retainer support arms 37 and 38 by being formed integrally with them (e.g., by forging).

Note also that the illustrated paired suction valve spring retainer support arms 37 and 38 occupy more space in plunger pump housing 50 than suction valve spring retainer support 33. This additional occupied space within pump housing 50 effectively reduces the unswept volume within pump housing 50 (i.e., the space within pump housing 50 that is neither cyclically occupied by a plunger during its reciprocating pumping motion nor occupied by any other structure). By thus reducing the unswept volume in pump housing 50, paired suction valve spring retainer support arms 37 and 38 can increase the volumetric efficiency of a plunger pump comprising the pump housing 50 and access bore plug 30' compared to the volumetric efficiency of a plunger pump comprising the pump housing 50 and access bore plug 30.

Figure 14:
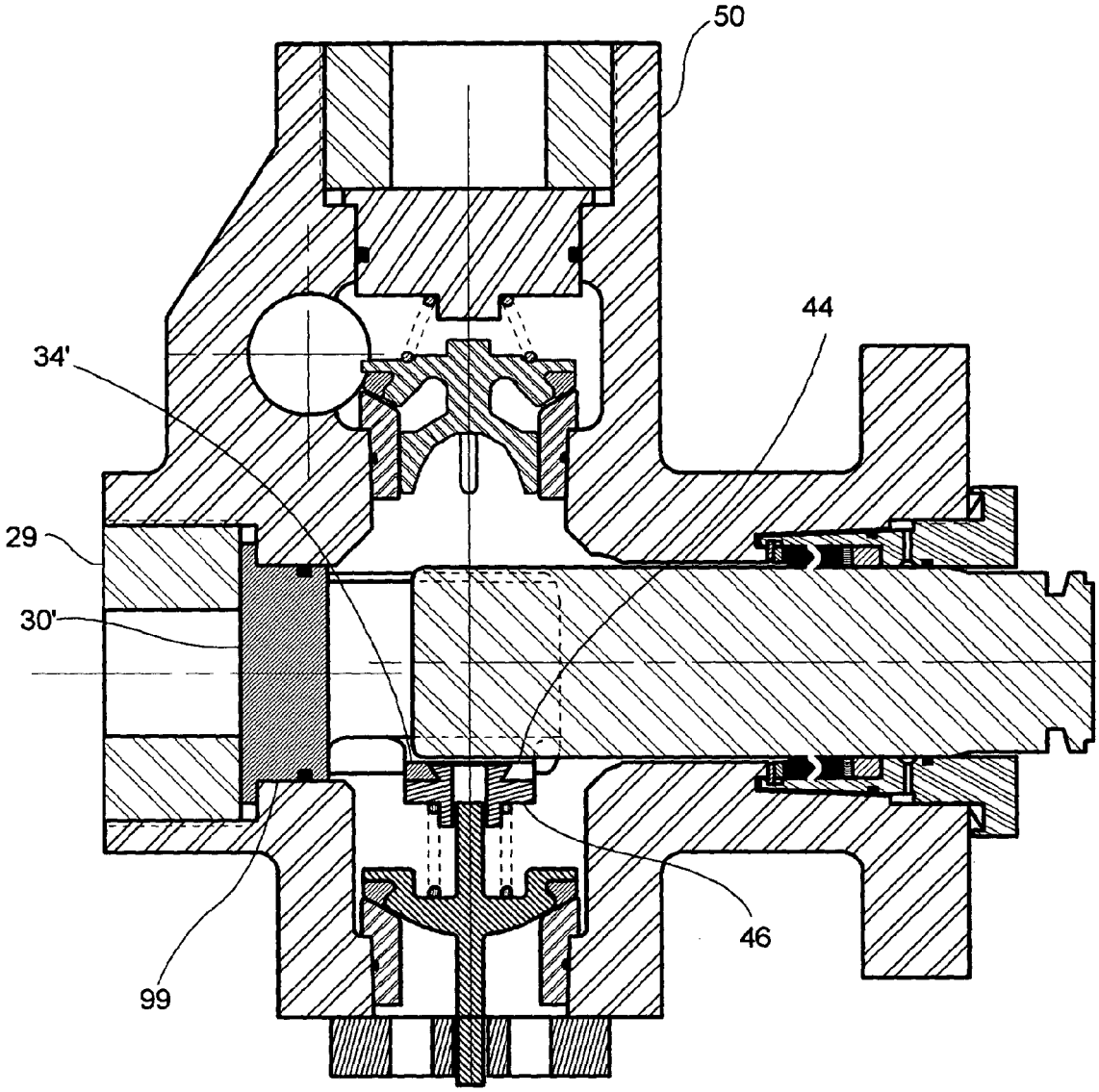
FIG. 14 schematically illustrates a right-angular plunger pump housing with an offset access bore, including suction and discharge valves, an access bore plug similar to that shown in FIGS. 11A, 11B and 11C, and a tapered cartridge packing assembly similar to that shown in FIG. 12A. Note the presence of a spring retainer comprising a suction valve top stem guide, the spring retainer being slidingly positioned in the suction valve spring retainer mounting bracket's longitudinal slot.

As discussed above for FIGS. 10A, 10B and 10C, but referring instead to FIGS. 11A, 11B and 11C, note also that suction valve spring retainer mounting bracket 34' and paired suction valve spring retainer support arms 37 and 38 comprise inner surfaces 35', 39 and 40 respectively. Each of the inner surfaces 35' 39 and 40 generally conforms to a cylindrical envelope and is slightly spaced apart from the cylindrical envelope. This cylindrical envelope can be visualized in FIG. 14 as being similar to that which is schematically illustrated by a broken line around the distal end of the plunger in FIG. 13. The broken line of the envelope is not actually drawn in FIG. 14 to avoid confusion with other features shown in FIG. 14. As noted above, the cylindrical envelope encompasses that space that would be cyclically occupied by a plunger's pumping movement in a plunger bore of plunger pump housing 50 in which access bore plug 30' may be secured. This envelope would closely approximate the surface of the plunger as shown in FIG. 14 because the plunger is shown (as in FIG. 13) at the distal end of its normal cyclic travel into pump housing 50. The slight spacing between the envelope and inner surfaces 35', 39 and 40 of suction valve spring retainer mounting bracket 34' and paired suction valve spring retainer support arms 37 and 38 respectively ensures that during its normal reciprocating motion in plunger pump housing 50, the plunger will not interfere with (i.e., contact) either suction valve spring retainer mounting bracket 34' or paired suction valve spring retainer support arms 37 and 38.

Other aspects of the present invention are schematically illustrated in FIGS. 12A–12E, which show cross-sections of various tapered cartridge packing and gland nut assemblies installed in plunger pump housings 47, 48, 49 and 50. For example, assembly 60 in FIG. 12A has a longitudinal axis and comprises a gland nut 22 and packing cartridge housing 62. Packing cartridge housing 62 has a distal end 64 and a proximal end 74, wherein the proximal end 74 is slightly distal to lubrication channel 87. When assembly 60 is installed in plunger pump housing 50, the longitudinal axis of assembly 60 is colinear with the third centerline of pump housing 50 as shown, for example, in FIGS. 13 and 14.

Figure 12A:
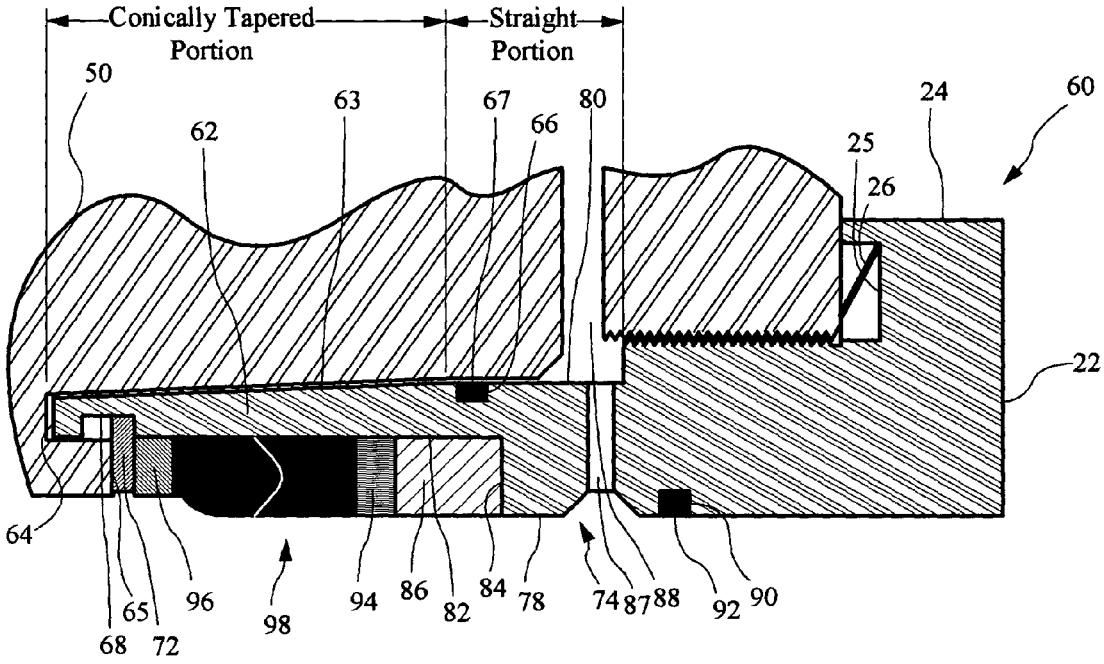
FIG. 12A schematically illustrates the extent of the right cylindrical outer surface portion of a tapered cartridge and gland nut assembly.
Figure 12B:
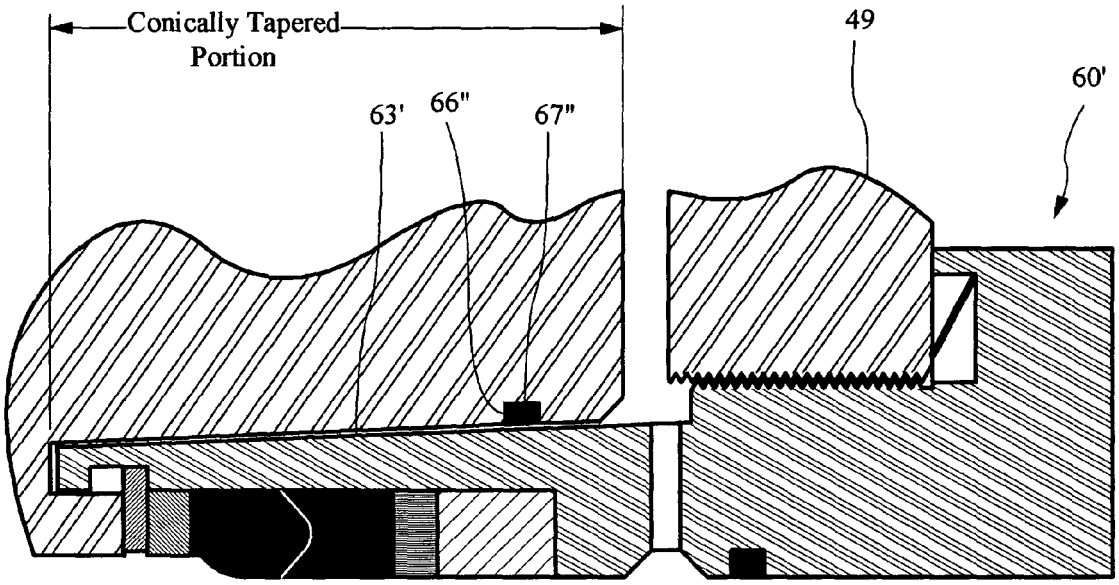
FIG. 12B schematically illustrates a portion of a plunger pump housing and a tapered packing cartridge and gland nut assembly in which the right cylindrical outer surface portion shown in FIG. 12A has been replaced by a continuation of the conically tapered outer surface, and the circumferential seal groove and its seal have been moved from the right cylindrical outer surface as shown in FIG. 12A to the inner surface of the portion of the pump housing into which the tapered packing cartridge and gland nut assembly is inserted.

Packing cartridge housing 62, as shown in partial cross-section in FIG. 12A, has a length between distal end 64 and proximal end 74, and a substantially right cylindrical inner surface 78 having a first diameter. A right cylindrical outer surface 80 is substantially coaxial with inner surface 78 and extends distally from proximal end 74 for a portion of said cartridge housing length. And a conically tapered substantially coaxial outer surface 63 extends distally from said distal extent of said right cylindrical outer surface 80 to distal end 64. Outer surface 63 tapers distally from right cylindrical outer surface 80 toward the longitudinal axis of assembly 60, which is colinear with the third centerline of pump housing 50.

Returning to FIG. 12A, inner surface 78 is seen to have a substantially coaxial cylindrical recess 82 having a second diameter greater than said first diameter and extending from distal end 64 proximally to an internal stop 84. Cylindrical recess 82 has a substantially coaxial internal snap ring groove 68, groove 68 having a substantially uniform width and a third diameter greater than said second diameter.

In assembly 60, a threaded gland nut 22 is integral with proximal end 74 of packing cartridge housing 62. Gland nut 22 comprises a shoulder 24, a shoulder seal groove 25 and an internal seal groove 90. A seal 26 lies within seal groove 25 for sealing shoulder 24 against a plunger pump housing 50. A seal 92 fitted within internal seal groove 90 of gland nut 22 for sealing against a plunger.

A substantially coaxial snap ring 72 lies within snap ring groove 68 and has a thickness less than said snap ring groove width. Snap ring 72 has an inner diameter slightly greater than said first diameter, an outer diameter slightly less than said third diameter, and a longitudinal sliding fit within snap ring groove 68. In the preferred embodiment schematically illustrated in FIG. 12A, a substantially coaxial packing compression ring 96 is positioned within cylindrical recess 82, between snap ring 72 and a packing ring 98. Packing compression ring 96 has an inner diameter slightly greater than said first diameter and an outer diameter slightly less than said second diameter.

The substantially coaxial packing ring 98 lying within cylindrical recess 82 has an inner diameter substantially equal to said first diameter and an outer diameter substantially equal to said second diameter. Packing ring 98 is positioned within recess 82 between packing compression ring 96 and anti-extrusion ring 94. Anti-extrusion ring 94 comprises a deformable material having a close sliding fit over a plunger within assembly 60, allowing it to retard or eliminate proximal extrusion of material from packing ring 98 along the plunger surface. Hence, the inner diameter of anti-extrusion ring 94 is slightly less than said first diameter and its outer diameter is about equal to said second diameter.

Anti-extrusion ring 94 is positioned in recess 82 between packing ring 98 and bearing ring 86. Bearing ring 86, which comprises bearing alloy, has an inner diameter slightly less than said first diameter and an outer diameter substantially equal to said second diameter. In use, bearing ring 86 contacts internal stop 84 as well as anti-extrusion ring 94.

When assembly 60 is manufactured, snap ring 72 is preferably positioned maximally distally within snap ring groove 68, with substantially the entire length of recess 82 between snap ring 72 and internal stop 84 occupied by packing compression ring 96, packing ring 98, anti-extrusion ring 94, and bearing ring 86 as described above. Note that an anti-extrusion ring, a packing compression ring, and/or a bearing ring may be absent in certain preferred embodiments, and that packing ring 98 may comprise one or more coaxial component rings arranged longitudinally (that is, stacked like washers). As an example of a preferred embodiment, two such component rings of packing ring 98 are schematically illustrated in FIG. 12A.

As assembly 60 is advanced distally over a plunger in plunger pump housing 50 (see, for example, FIGS. 13 and 14), snap ring 72 encounters adjusting ring 65, which is a coaxial boss integral with housing 50 (returning, for example, to FIG. 12A). Continued distal advancement of assembly 60 will cause snap ring 72 to move proximally (longitudinally) within snap ring groove 68. In turn, proximally directed longitudinal sliding movement of snap ring 72 within snap ring groove 68 causes proximally directed longitudinal sliding movement of packing compression ring 96 with resultant compression of packing ring 98 and tighter sealing of the packing around a plunger lying within cartridge packing housing 62.

Conversely, if distally directed sliding movement of snap ring 72 within snap ring groove 68 is allowed, as during extraction of tapered cartridge packing and gland nut assembly 60 over a plunger in a plunger pump housing 50, compressed packing ring 98 will tend to push snap ring 72 distally so as to relieve the compression. Such compression relief in packing ring 98 will loosen the seal of packing ring 98 around a plunger lying within cartridge packing housing 62, facilitating continued extraction of assembly 60.

Following extraction of assembly 60 from plunger pump housing 50, a plunger may be removed from plunger pump housing 50 with reduced resistance. Prior extraction of assembly 60 allows subsequent rotation of a plunger into space formerly occupied by assembly 60. This rotation provides sufficient clearance for removal of the plunger past power section components.

In addition to assembly 60, other embodiments of tapered cartridge packing and gland nut assemblies of the present invention also provide for easy removal of a plunger as above. For example, tapered cartridge packing and gland nut assembly 60' (shown in partial cross-section in FIG. 12B) is similar to assembly 60 but differs in that the substantially coaxial right cylindrical outer surface 80 has been replaced by a proximal extension of conically tapered substantially coaxial outer surface 63, the extended conically tapered surface being labeled 63'. Additionally, assembly 60' does not include circumferential seal groove 66 with its elastomeric seal 67. Instead, assembly 60' is intended for use in a pump housing 49 that matches the conical taper of assembly 60' and that comprises an elastomeric seal 67" within an inner circumferential seal groove 66".

Tapered cartridge packing and gland nut assembly 61 (shown in partial cross-section in FIG. 12C) is similar to assembly 60 but differs in that snap ring groove 68 and snap ring 72 have been eliminated. Additionally, assembly 61 does not include circumferential seal groove 66 with its elastomeric seal 67. Instead, assembly 61 is intended for use in a pump housing 48 that matches the conical taper and cylindrical outer surface of assembly 61. In its proximal packing area, pump housing 48 is similar to pump housing 50 except that pump housing 48 comprises an elastomeric seal 67" within an inner circumferential seal groove 66".

When removing assembly 61 from pump housing 48 over a plunger (not shown in FIG. 12C), for example, packing compression ring 96 and coaxial packing ring 98 may remain on the plunger because of the close fit of packing ring 98 on the plunger. After removal of the tapered portion of assembly 61 that surrounds packing ring 98, however, ring 98 and any other components of assembly 61 that may remain around the plunger will not impede its removal.

Figure 1:
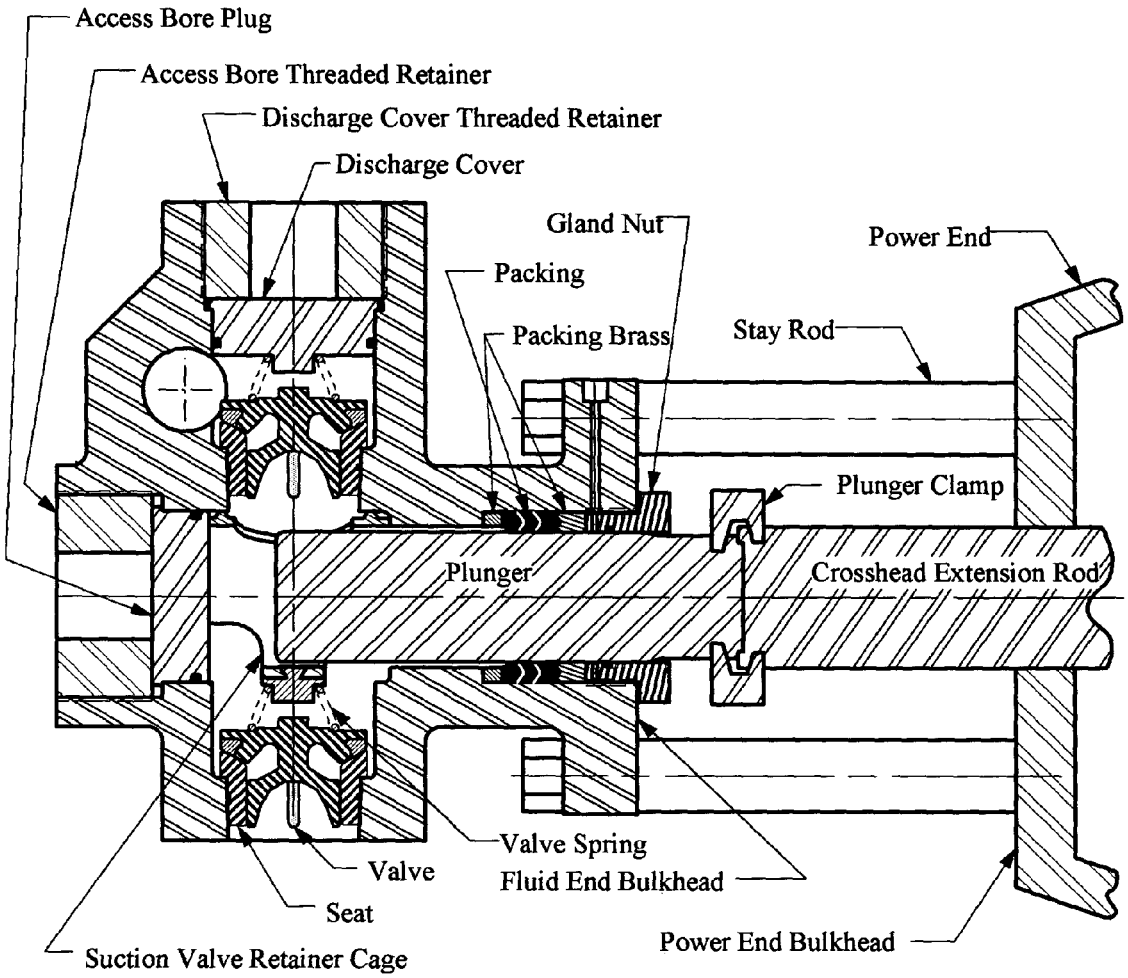
Prior Art Figure 1
FIG. 1 is a cross-sectional schematic view of a conventional plunger pump fluid section housing showing its connection to a power section by stay rods.
Figure 2:
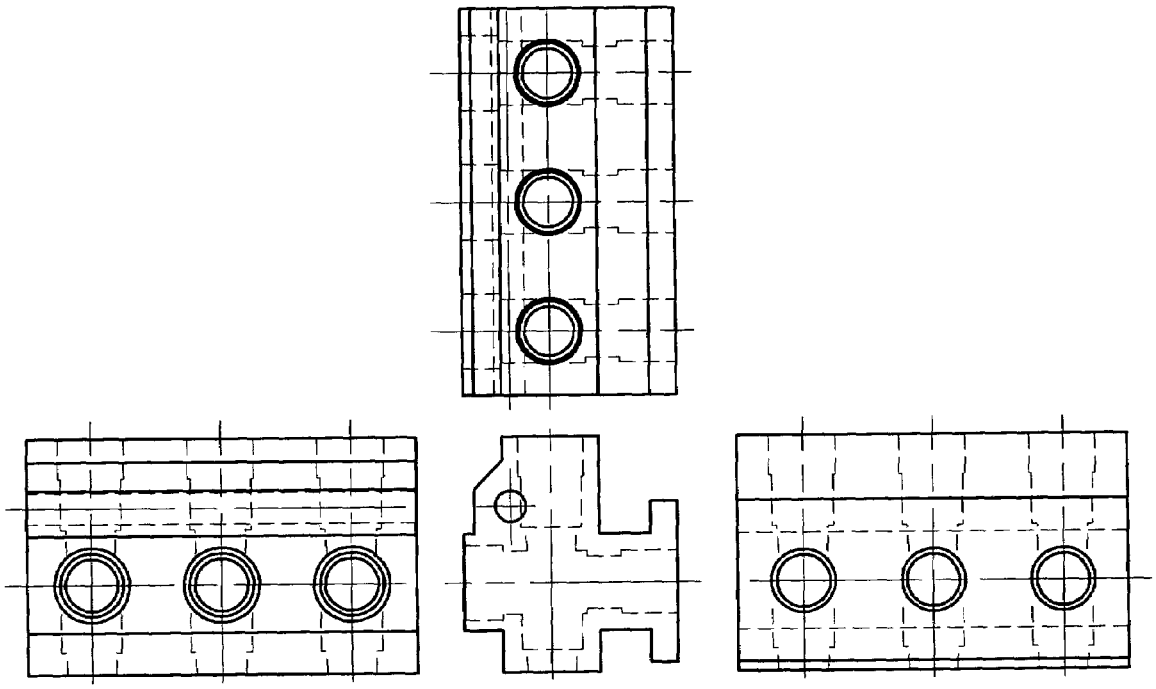
Prior Art Figure 2
FIG. 2 schematically illustrates a conventional Triplex plunger pump fluid section.
Figure 3:
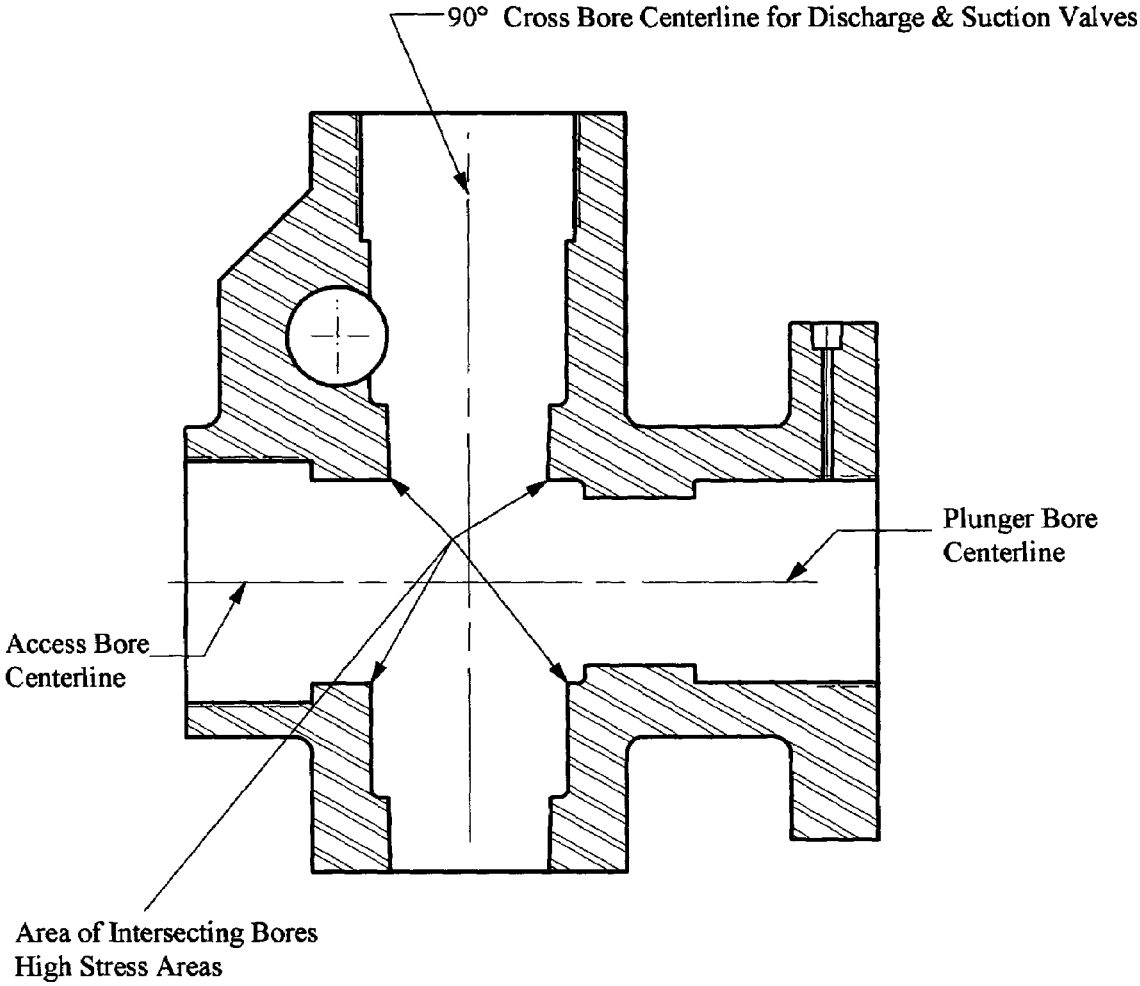
Prior Art Figure 3
FIG. 3 is a cross-sectional schematic view of suction, plunger, access and discharge bores of a conventional plunger pump housing intersecting at right angles showing areas of elevated stress.
Figure 4:
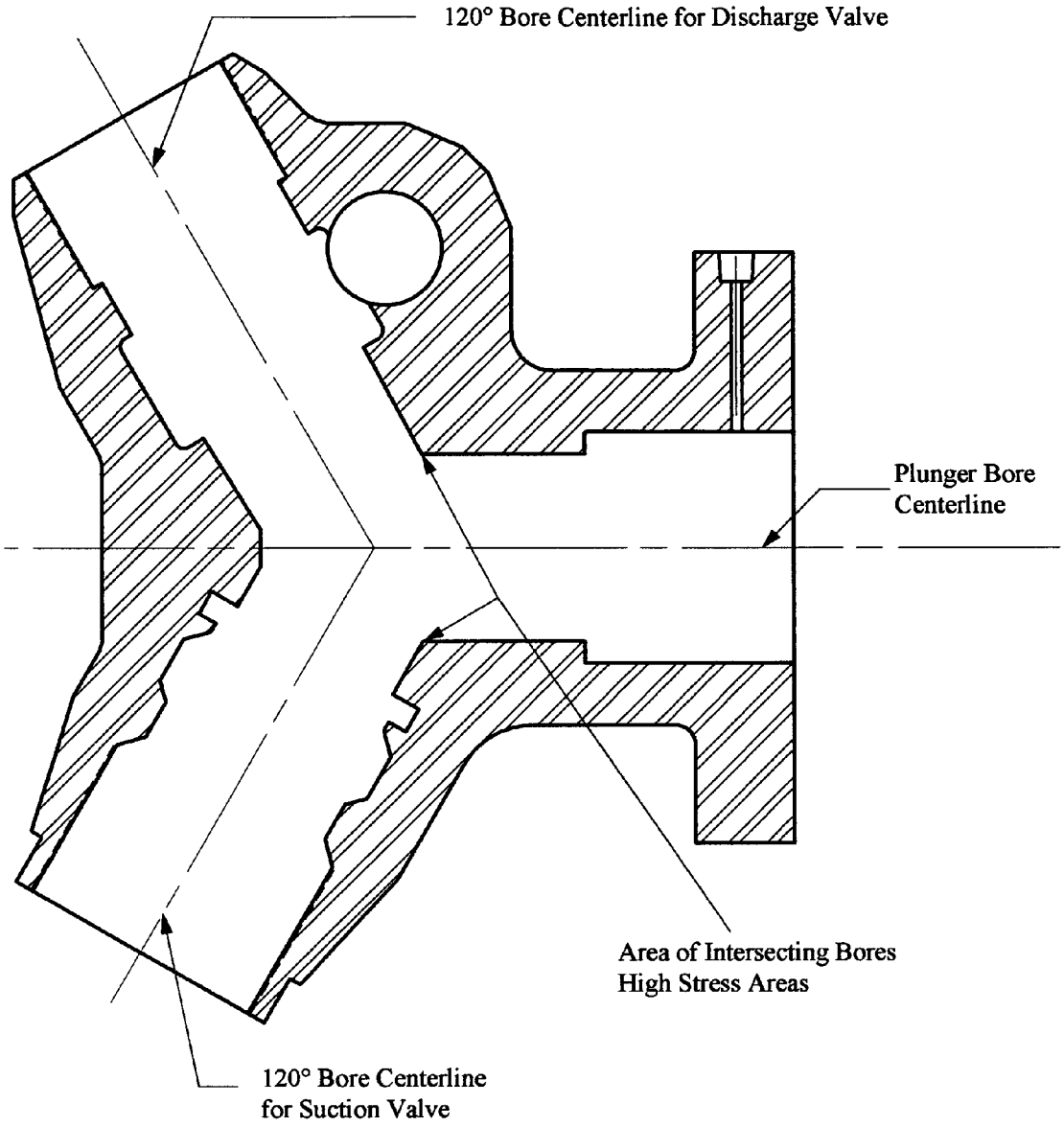
Prior Art Figure 4
FIG. 4 is a cross-sectional schematic view of suction, plunger and discharge bores of a Y-block plunger pump housing intersecting at obtuse angles showing areas of elevated stress.
Figure 5:
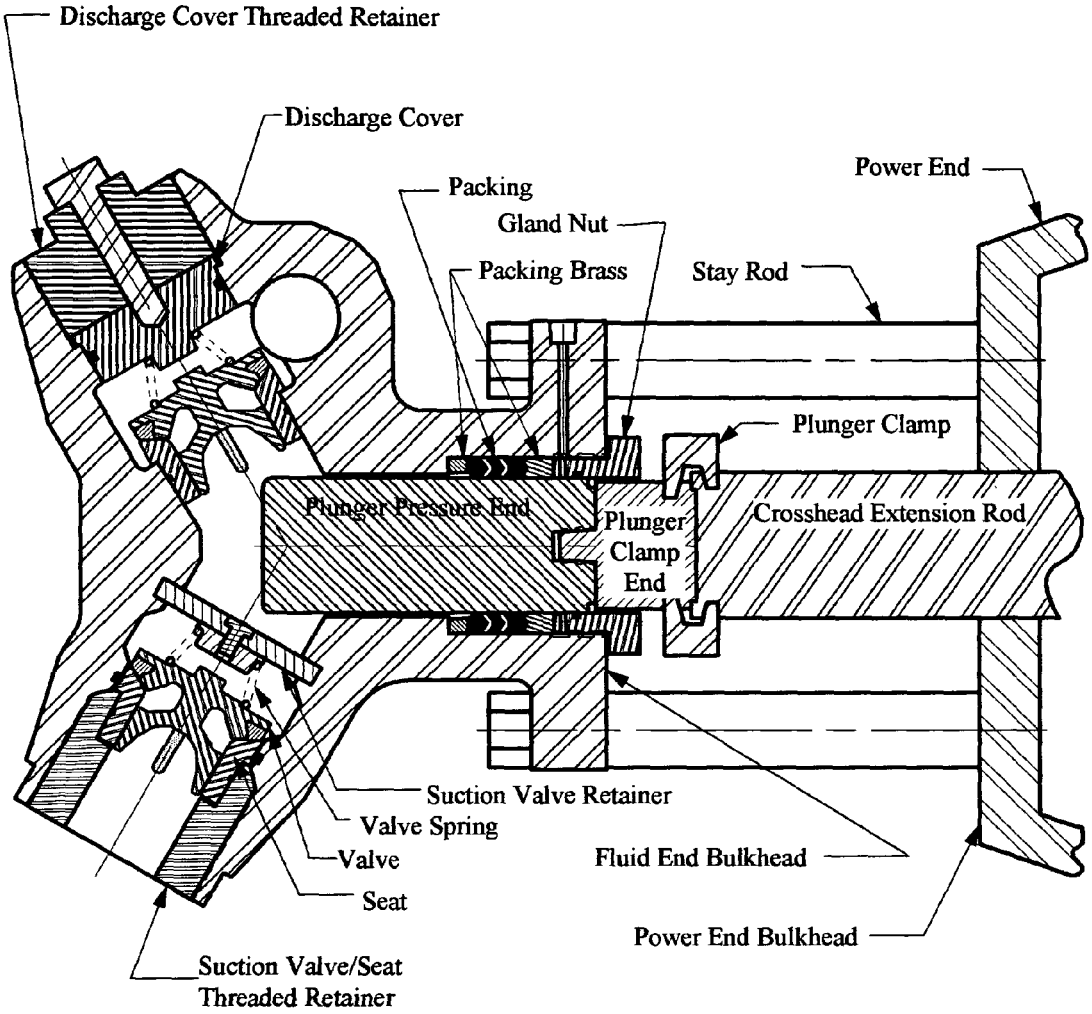
Prior Art Figure 5
FIG. 5 is a cross-sectional schematic view similar to that in FIG. 4, including internal plunger pump components.
Figure 6:
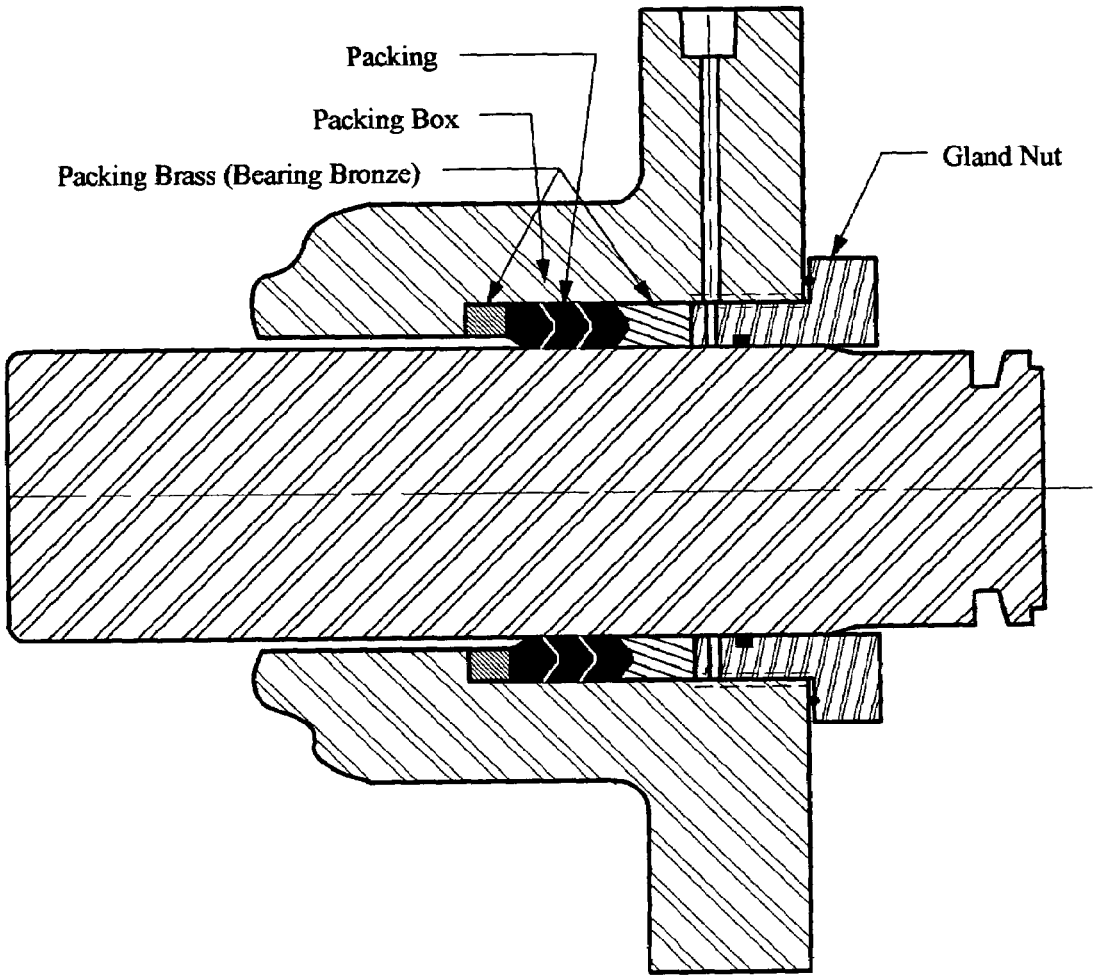
Prior Art Figure 6
FIG. 6 is a partial cross-sectional schematic view of conventional plunger packing and packing brass.
Figure 7:
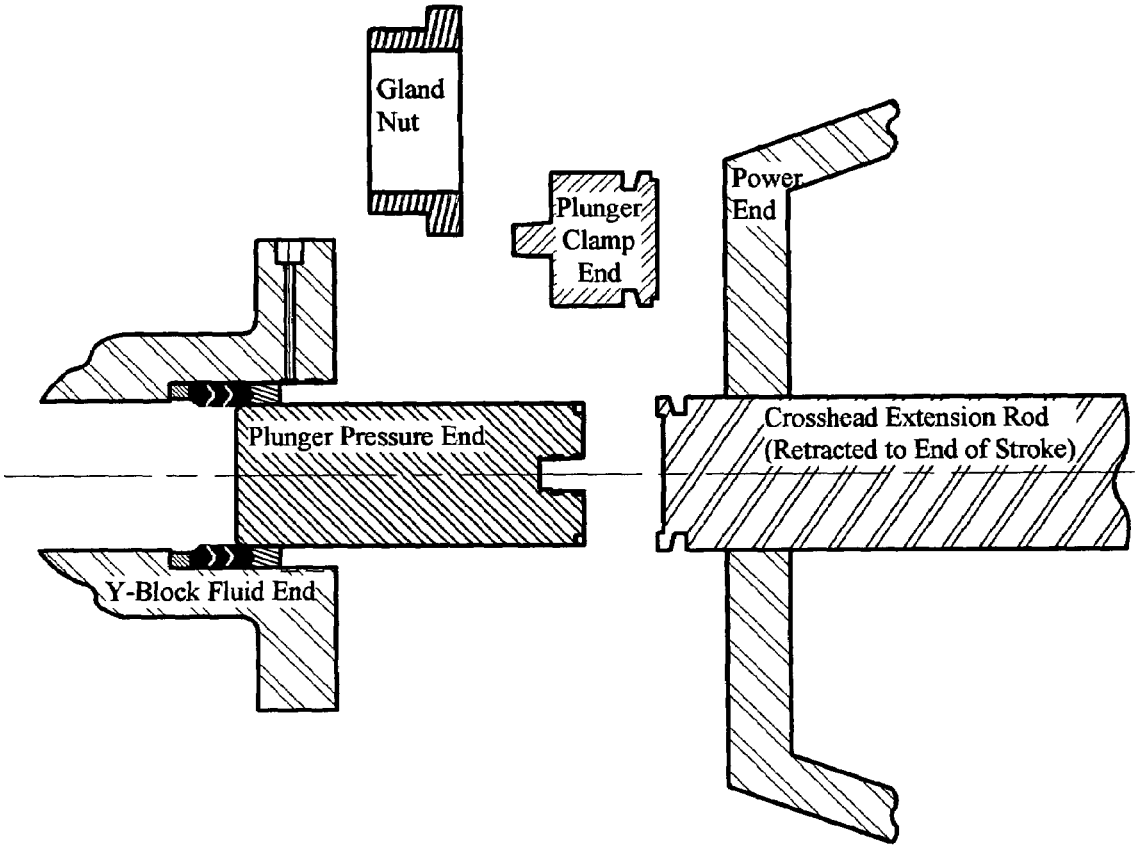
Prior Art Figure 7
FIG. 7 schematically illustrates portions of a Y-block plunger pump housing, together with a gland nut and plunger parts, with the plunger pressure end within the packing box.
Figure 8:
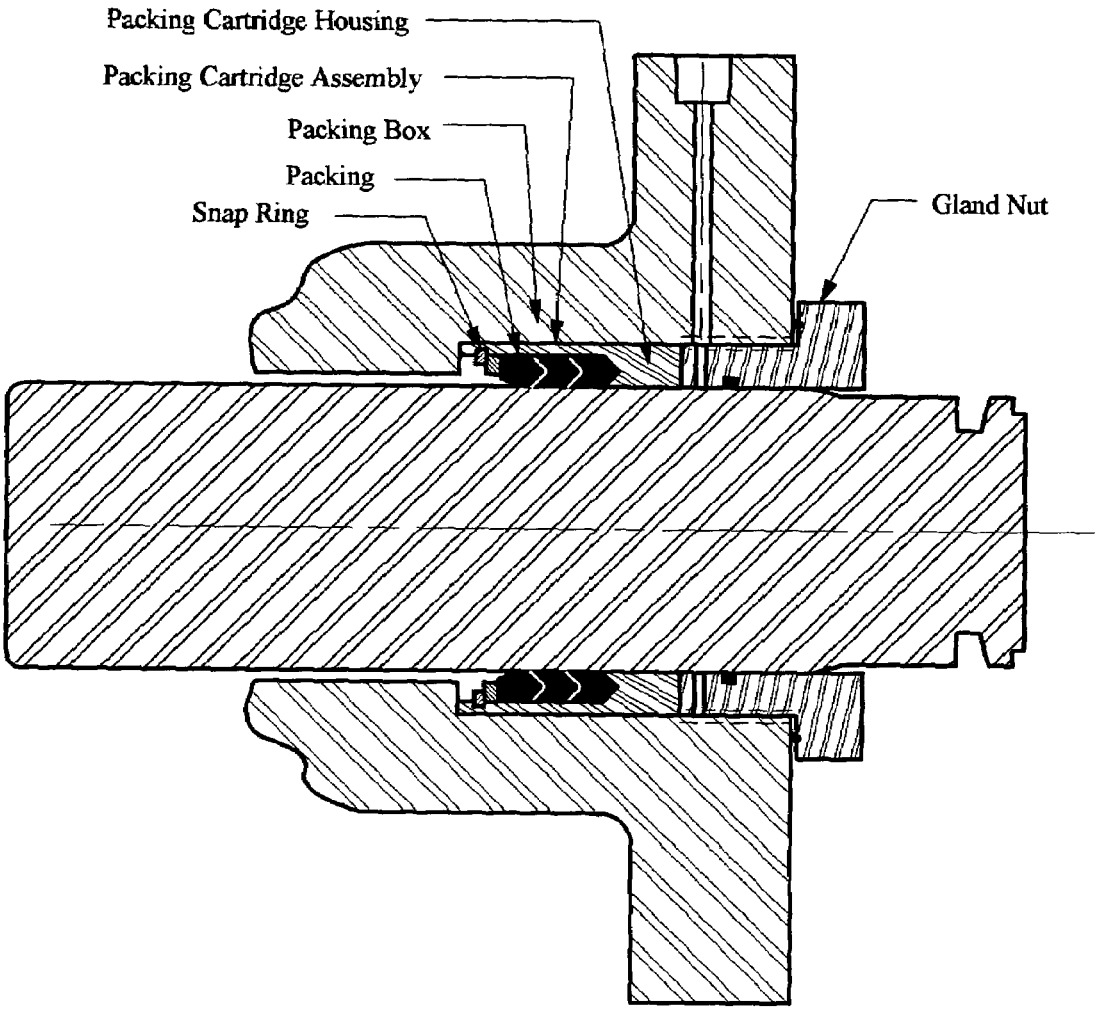
Prior Art Figure 8
FIG. 8 schematically illustrates a partial cross-sectional view of a plunger pump housing, together with a conventional packing cartridge and gland nut.
Figure 9:
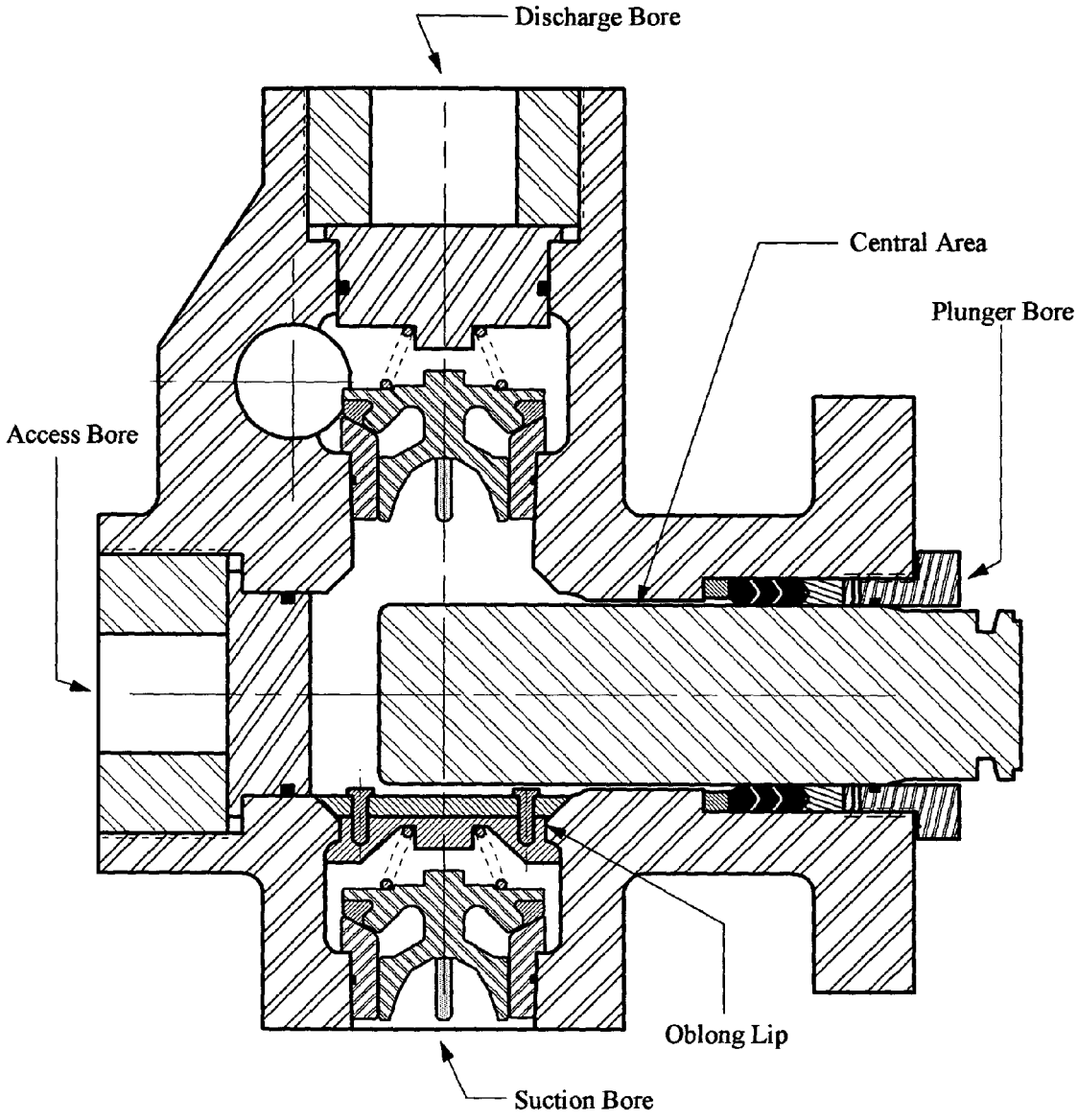
FIG. 9 schematically illustrates a cross-section of a right-angular plunger pump housing showing structures of the '706 application, including suction and discharge valves, plunger, and a suction valve spring retainer clamped about a lip of the housing.

Note that packing ring 98 may comprise a single segment or may preferably comprise two or more adjacent packing ring segments that fit together in a (commonly used) chevron configuration (see, for example, U.S. Pat. No. 4,878,815, incorporated herein by reference). The chevron configuration facilitates tightening of packing ring 98 over a plunger as packing ring 98 is longitudinally compressed. Note, however, that the chevron packing rings of the '815 patent have a tapered outside diameter to fit inside a correspondingly tapered stuffing box (see FIG. 2 of the '815 patent). In contrast, packing ring 98 of the present invention does not have such a tapered outside diameter, since it is located within the substantially coaxial cylindrical recess of a packing cartridge housing.

Figure 12C:
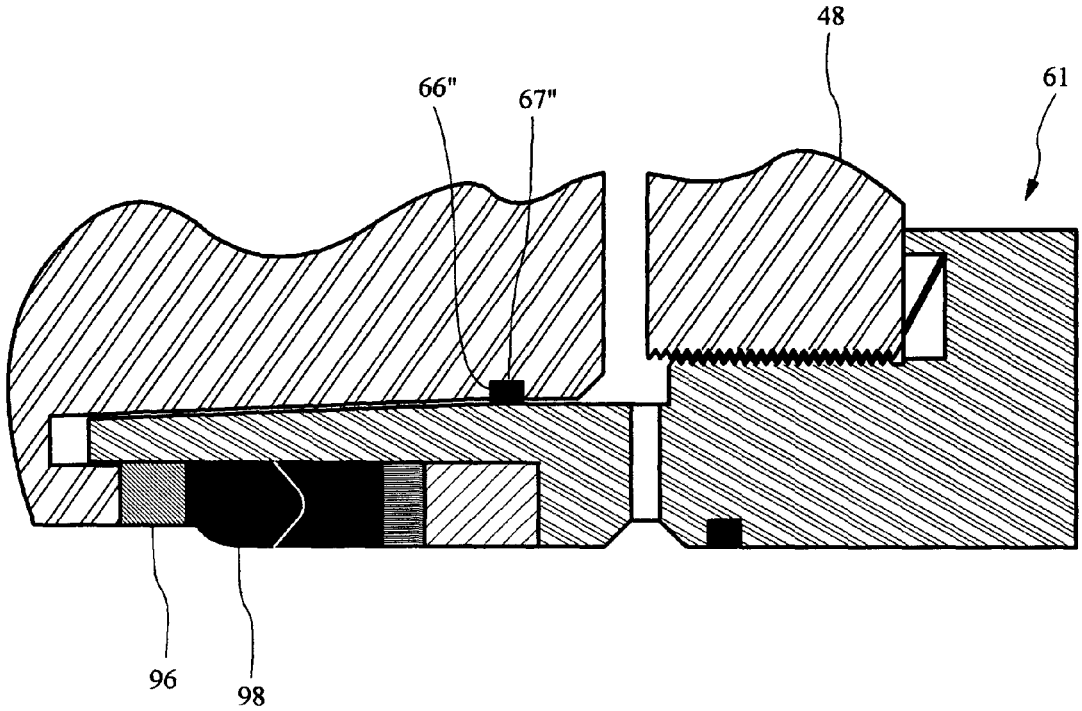
FIG. 12C schematically illustrates a portion of a plunger pump housing and a tapered packing cartridge and gland nut assembly in which the snap ring and snap ring groove shown in FIG. 12A have been eliminated.
Figure 12D:
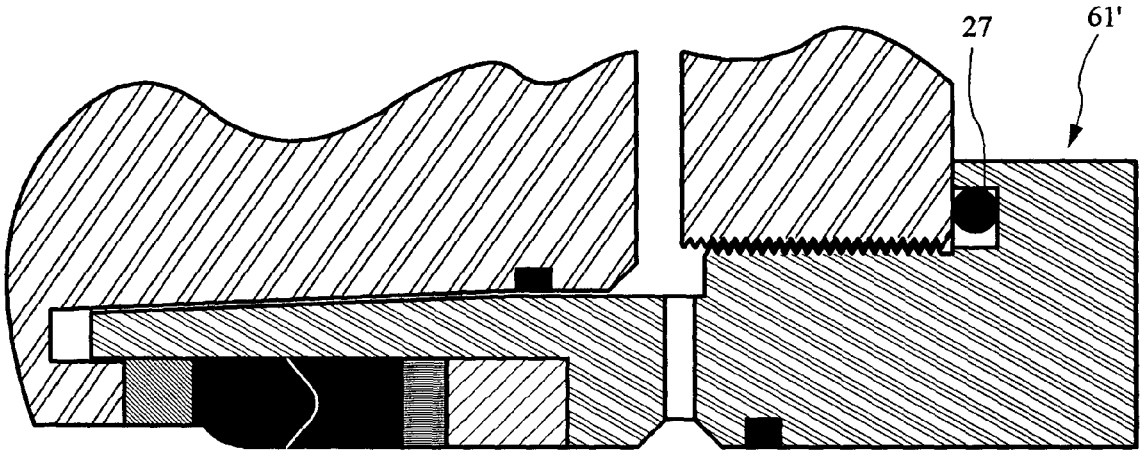
FIG. 12D schematically illustrates a portion of a plunger pump housing and a tapered packing cartridge and gland nut assembly in which the Bellville spring of FIG. 12C is replaced by an O-ring seal.
Figure 12E:
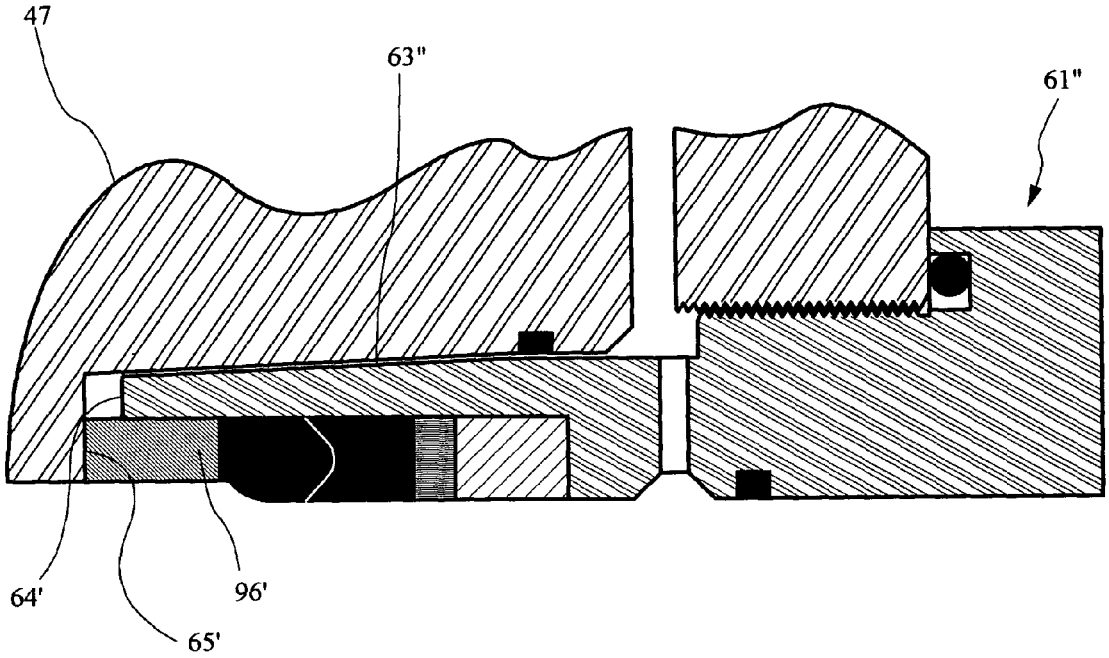
FIG. 12E schematically illustrates a portion of a plunger pump housing and a tapered packing cartridge and gland nut assembly in which the packing compression ring of FIG. 12D lies partially within the cylindrical recess.

Tapered cartridge packing and gland nut assembly 61' (shown in partial cross-section in FIG. 12D) is similar to assembly 61 in FIG. 12C but differs in that Bellville spring seal 26 is replaced by O-ring seal 27. O-ring seal 27 would generally provide less adjustment range for sealing a packing ring 98 around a plunger than Bellville spring seal 26, but may be an acceptable alternative. Indeed, since the lube oil leaks that seals 26 and 27 are intended to stop are themselves relatively small, a tapered cartridge packing and gland nut assembly may be used without either such seal. The relatively viscous nature of lube oil and the relatively low lube oil pressures commonly used mean that some users may choose to accept leaks rather than tying to seal against them.

Tapered cartridge packing and gland nut assembly 61' (shown in partial cross-section in FIG. 12E) is similar to assembly 61 in FIG. 12C but differs in that packing compression ring 96' extends beyond distal end 64' of conically tapered outer surface 63". Assembly 61" is thus intended for use in a pump housing 47 in which adjusting ring 65' is a relatively shorter height coaxial boss than adjusting ring 65 in assembly 60, the lower limit of height for coaxial boss 65' being zero. Where the coaxial boss height is reduced to zero, machining of corresponding pump housing 47 would be simplified compared to machining of pump housing 48, 49 or 50 (each of which has a coaxial boss height greater than zero).

FIG. 13 schematically illustrates a right-angular plunger pump housing with an offset access bore, including suction and discharge valves, an access bore plug 30 as shown in FIGS. 10A, 10B and 10C, and a tapered cartridge packing assembly similar to that shown in FIG. 12A. Note the presence of a suction valve spring retainer 45 slidingly engaged in longitudinal slot 44 of suction valve spring retainer mounting bracket 34. FIG. 14 analogously schematically illustrates a right-angular plunger pump housing with an offset access bore, including suction and discharge valves, an access bore plug 30' as shown in FIGS. 11A, 11B and 11C, and a tapered cartridge packing assembly similar to that shown in FIG. 12A. Note the presence of a suction valve spring retainer 46 that further comprises a suction valve top stem guide. FIG. 14 shows spring retainer 46 slidingly engaged in longitudinal slot 44 of suction valve spring retainer mounting bracket 34'. Sliding engagement of suction valve spring retainer 45 or 46 as described above in longitudinal slot 44 restrains lateral movement of spring retainer 45 or 46, as well as longitudinal movement of spring retainer 45 or 46 toward cylindrical portion 32 of access bore plug 30 or 30'. Longitudinal movement of spring retainer 46 away from cylindrical portion 32 is also dynamically restricted as explained below. Note that movement of a suction valve spring that may be coupled to spring retainer 45 or 46 as shown, for example, in FIGS. 13 and 14, is restricted in a similar manner to that described above because the suction valve spring will have a self-centering tendency due to its substantially symmetrical shape and its substantially symmetrical placement within a suction bore. Note also that no part of spring retainer 45 or 46 protrudes through longitudinal slot 44 and past inner surface 35 or 35' respectively during sliding engagement. This prevents interference by spring retainer 45 or 46 with cyclic movement of a plunger in the pump housing.

FIGS. 13 and 14 show how a suction valve spring retainer 45 (see FIG. 13), and a suction valve spring retainer 46 comprising a suction valve top stem guide (see FIG. 14), are secured in position by suction valve spring retainer mounting brackets 34 and 34' respectively. As shown in FIGS. 13 and 14, both the respective spring retainer mounting bracket and its associated spring retainer are substantially centrally located over the suction bore transition area in plunger pump housing 50. Also shown in FIGS. 13 and 14 is the manner in which longitudinal slot 44 in spring retainer mounting bracket 34 or 34' respectively slidingly engages suction valve spring retainer 45 or 46 upon insertion of the respective access bore plug into plunger pump housing 50.

A suction valve spring such as that shown in FIG. 13 or FIG. 14 may be temporarily compressed by pressure on its respective spring retainer (which is coupled to the spring in a manner analogous to that shown in FIGS. 13 and 14). Such pressure may be exerted, for example, by force temporarily applied to a spring-compression tool inserted through the discharge bore. If sufficient pressure is exerted on the spring retainer by the spring-compression tool, an access bore plug of the present invention may be simultaneously inserted to slidingly engage the spring retainer with longitudinal slot 44 of spring retainer mounting bracket 34 or 34' as shown in FIGS. 13 and 14 respectively. Subsequent release of force applied to the spring-compression tool will allow the spring retainer to contact the respective spring retainer mounting bracket. The respective access bore plug may then be secured in plunger pump housing 50 with a threaded access bore plug retainer 29 to retain the suction valve spring in the plunger pump housing. Note that while suction valve spring retainer 46 may be free to move longitudinally away from cylindrical portion 32 (i.e., toward the open end of longitudinal slot 44) when spring retainer mounting bracket 34 or 34' is positioned as above and the suction valve is open, flow pressures acting on the open suction valve (and thus on the valve's top stem guide) as fluid is drawn past the suction valve into the pump housing will tend to dynamically restrict such movement.

Figure 15A:
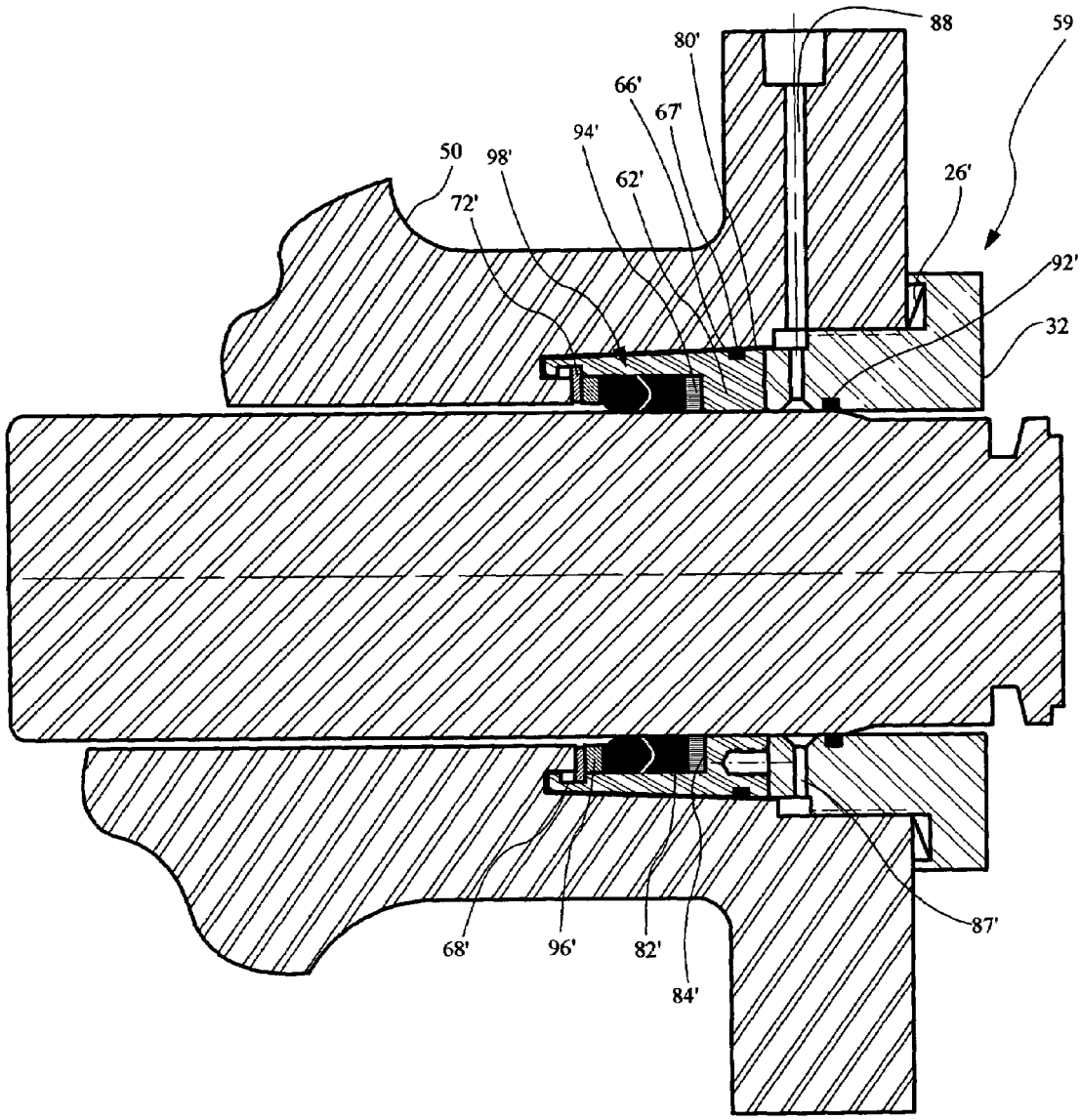
FIG. 15A schematically illustrates a partial cross-sectional view of a plunger pump housing of the present invention with a plunger, a tapered packing cartridge assembly, and a (separable) gland nut in place.

An alternative embodiment for the tapered cartridge packing shown in FIGS. 13 and 14 is seen in FIG. 15A, which schematically illustrates a separable tapered cartridge packing and gland nut assembly 59 comprising tapered cartridge packing housing 62' in use with a separate (removable) gland nut 32.

Referring to FIG. 15A, at least one and preferably a plurality of radial lubricating channels 88 in housing 50 communicate with at least one and preferably a plurality of corresponding channels 87' within gland nut 32, allowing for lubrication of a plunger within packing cartridge housing 62'. After entering through channels 88 and 87', plunger lubricant is prevented from leaking distally by elastomeric seal 67' and packing ring 98', while elastomeric seal 92' and Bellville spring seal 26' prevent proximal leakage.

At least one circumferential seal groove 66' preferably lies in right cylindrical outer surface 80', and an elastomeric seal 67' is fitted within each circumferential seal groove 66' to seal against fluid leakage around the outer surfaces of cartridge packing housing 62'. Note that the sealing function of elastomeric seal 67' may be replaced by a similar function achieved with one or more circumferential seal grooves, with corresponding elastomeric seal(s), that may alternatively lie in pump housing 50 instead of on the outer surface of cartridge packing housing 62'.

Since cartridge packing housing 62' comprises bearing alloy, there is no need in the embodiment of FIG. 15A for a substantially coaxial bearing ring 86 (as shown, for example, in FIG. 12A) within cylindrical recess 82'. However, preferred embodiments of the invention may comprise a substantially coaxial anti-extrusion ring 94' lying within cylindrical recess 82' between packing ring 98' and internal stop 84'. Anti-extrusion ring 94' comprises a deformable material having a close sliding fit over a plunger within assembly 59. Hence, the inner diameter of anti-extrusion ring 94' is slightly less than said first diameter and its outer diameter is about equal to said second diameter.

A substantially coaxial snap ring 72' lies within snap ring groove 68' and has a thickness less than said snap ring groove width. Snap ring 72' has an inner diameter slightly greater than said first diameter, an outer diameter slightly less than said third diameter, and a longitudinal sliding fit within snap ring groove 68'. A substantially coaxial packing compression ring 96' is positioned within cylindrical recess 82', between snap ring 72' and packing ring 98' and preferably contacting snap ring 72'. Packing compression ring 96' has an inner diameter slightly greater than said first diameter and an outer diameter slightly less than said second diameter.

A substantially coaxial packing ring 98' lies within cylindrical recess 82'. Packing ring 98' has an inner diameter substantially equal to said first diameter, an outer diameter substantially equal to said second diameter, and sufficient length to substantially fill cylindrical recess 82' between anti-extrusion ring 94' (when present) and packing compression ring 96' (when present) when snap ring 72' is positioned maximally distally within snap ring groove 68'. Note that an anti-extrusion ring and/or a packing compression ring may be absent in certain preferred embodiments, and that coaxial packing ring 98' may comprise one or more coaxial component rings arranged longitudinally (that is, stacked like washers). As an example of a preferred embodiment, two such component rings are schematically illustrated in FIG. 15A.

FIG. 15A schematically illustrates an embodiment of the invention wherein gland nut 22, an integral part of tapered cartridge packing and gland nut assembly 60, is replaced by removable gland nut 32. Note that when gland nut 32 is removed from plunger pump housing 50, leaving cartridge packing housing 62' in place, proximal traction on the plunger will be required to extract housing 62' from plunger pump housing 50. In this configuration, cartridge packing housing 62' will tend to follow the plunger as it is withdrawn proximally because the friction of packing ring 98' on a proximally moving plunger will usually exceed the friction of circumferential seal 67' on plunger pump housing 50. However, when packing ring 98' is well worn, its friction force on the plunger may be so reduced that cartridge packing housing 62' may not follow plunger as it is withdrawn proximally. Such a failure to withdraw cartridge packing housing 62' will prevent removal of the plunger because the plunger will not be rotatable if cartridge packing housing 62' remains installed in pump housing 50.

Figure 15B:
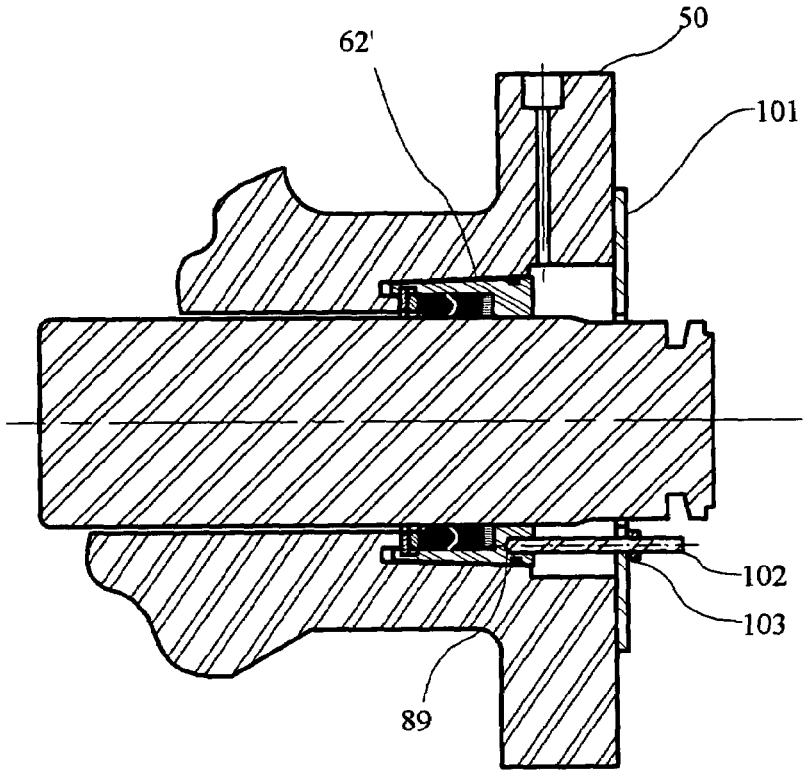
FIG. 15B schematically illustrates a plunger pump housing similar to that in FIG. 15A but wherein the separable gland nut has been replaced by jackscrews, jackscrew nuts and a jackscrew plate to facilitate removal of a tapered packing cartridge packing assembly.
Figure 15C:
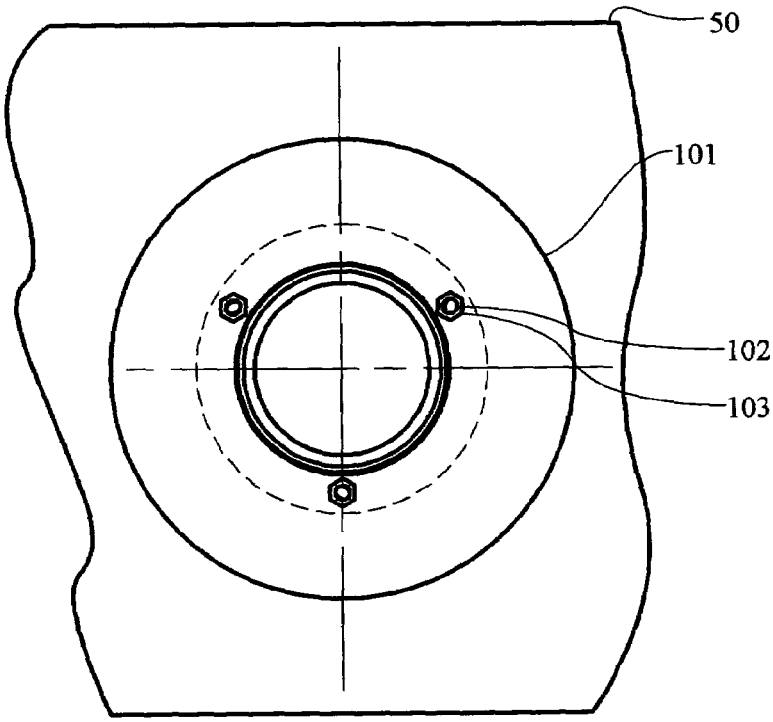
FIG. 15C schematically illustrates an end view of the jackscrew plate, jackscrews and jackscrew nuts of FIG. 15B.

Thus, it may sometimes be necessary to extract housing 62' from pump housing 50 without relying on simultaneous withdrawal of a plunger. To accomplish extraction of housing 62' under this condition, three or more threaded jackscrew rods (or bolts) 102 may be screwed into three or more corresponding threaded bores 89 spaced uniformly around housing 62' in locations analogous to that shown in FIG. 15B. Next, a jackscrew plate 101 is positioned over (because it is larger than) the area of plunger pump housing 50 into which gland nut 32 is threaded (see, for example, FIGS. 15B and 15C). Plate 101 has a central hole that fits easily over a plunger, with three or more surrounding holes corresponding to threaded jackscrew rods 102 (seen in the partial end view of FIG. 15C). Following such positioning of plate 101 over a plunger and threaded jackscrew rods 102, correspondingly threaded nuts 103 are screwed on each jackscrew rod, allowing housing 62' to be smoothly withdrawn toward plate 101 over a plunger as nuts 103 are incrementally tightened on rods 102. After cartridge packing housing 62' is thus withdrawn, the plunger will then be easily removable.

Figure 17A:
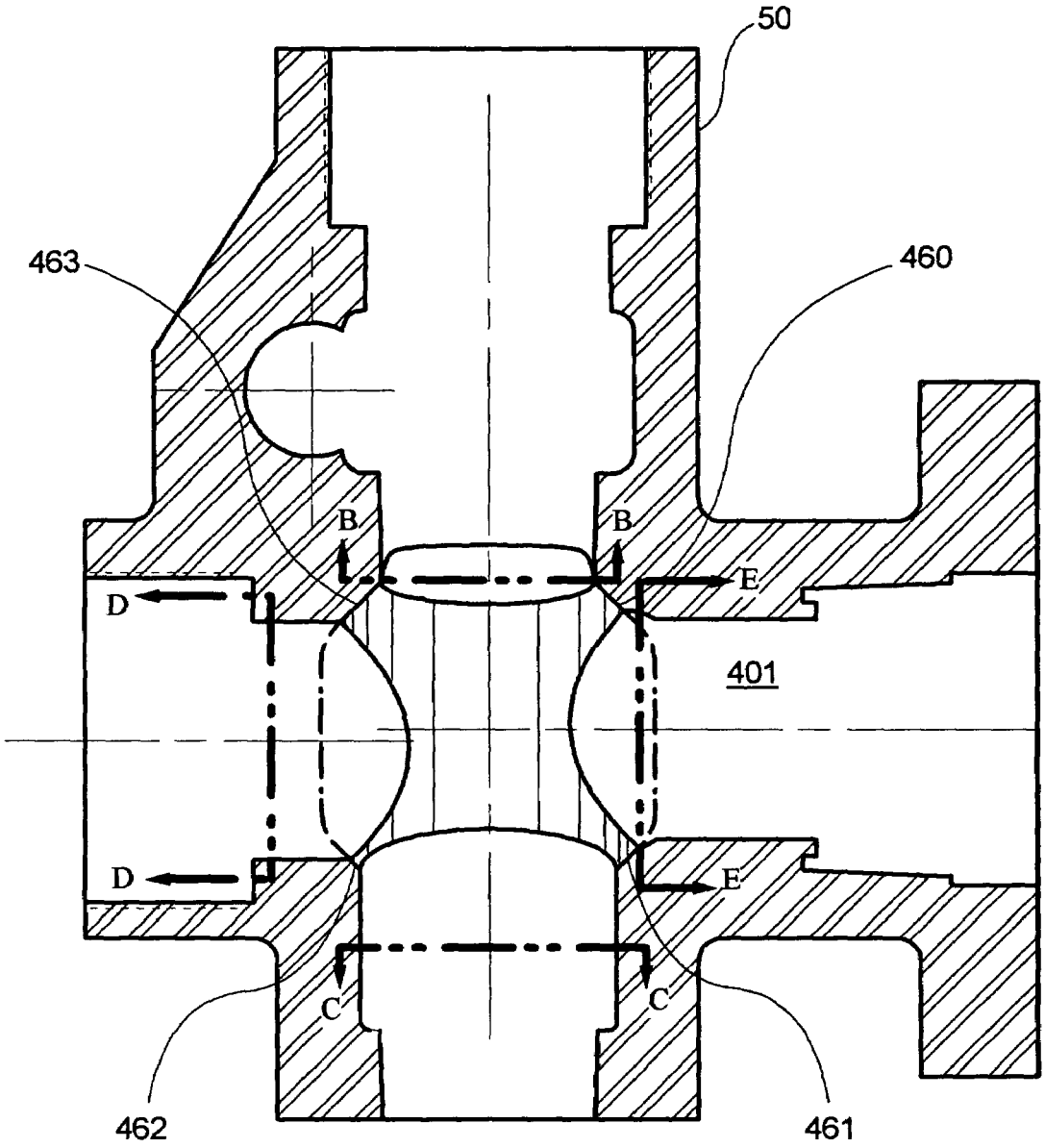
FIG. 17A schematically illustrates a typical right-angular plunger pump housing of the present invention showing the area of largest bore as surrounding the common centerline of the suction and discharge bores.
Figure 17B:
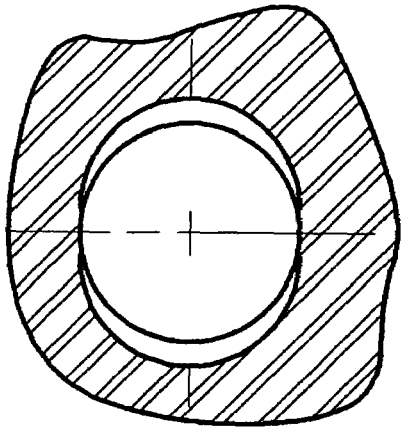
FIG. 17B schematically illustrates the transverse cross-section labeled B—B in FIG. 17A.
Figure 17C:
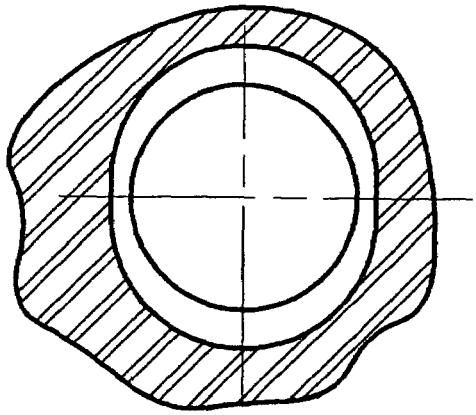
FIG. 17C schematically illustrates the transverse cross-section labeled C—C in FIG. 17A.
Figure 17D:
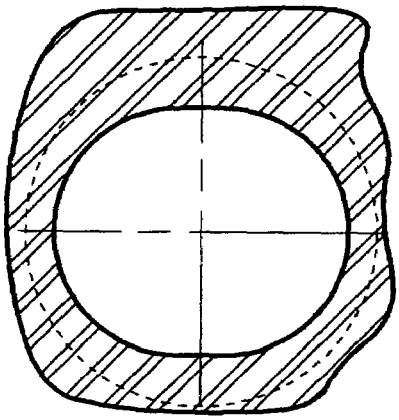
FIG. 17D schematically illustrates the transverse cross-section labeled D—D in FIG. 17A.
Figure 17E:
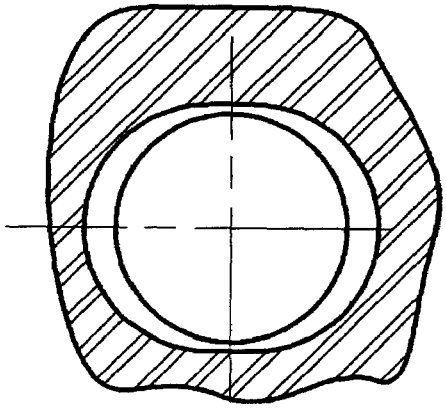
FIG. 17E schematically illustrates the transverse cross-section labeled E—E in FIG. 17A.

The chamfers 460, 461, 462 and 463, schematically illustrated in cross-section in FIG. 17A, are (as noted above) stress-reducing features in pump housing 50 of the present invention. The cross-sectional view of FIG. 17A shows chamfers 460 and 461 on either side of the plunger bore transition area, chamfers 461 and 462 on either side of the suction bore transition area, chamfers 462 and 463 on either side of the access bore transition area, and chamfers 463 and 460 on either side of the discharge bore transition area. Transverse cross-sectional views of the plunger bore transition area, the suction bore transition area, the access bore transition area, and the discharge bore transition area are indicated respectively by the sections E—E, C—C, D—D and B—B shown in FIG. 17A. The transition area transverse cross-sections E—E, C—C, D—D and B—B themselves are schematically illustrated in FIGS. 17E, 17C, 17D and 17B respectively. Note that the discharge valve bore transition area transverse cross-sectional view in FIG. 17B includes a substantially circular portion for accommodating a circular discharge valve, as well as an elongated portion that represents a transverse cross-section of the discharge bore transition area. Analogously, the suction valve bore transition area transverse cross-sectional view in FIG. 17C includes a substantially circular portion for accommodating a circular suction valve, as well as an elongated portion that represents a transverse cross-section of the suction bore transition area. The plunger bore transition area transverse cross-sectional view in FIG. 17E includes a substantially circular portion representing the central area 401 of the plunger bore, as well as an elongated portion that represents a transverse cross-section of the plunger bore transition area. The diameter of the circular portion shown in FIG. 17E is thus the diameter of central area 401 (i.e., central area diameter), and the centerline of central area 401 (i.e., the third centerline) is shown in FIG. 17A. The access bore transition area transverse cross-sectional view in FIG. 17D shows the elongated shape of a transverse cross-section of the access bore's cylindrical portion. The centerline of the access bore's cylindrical portion (i.e., the fourth centerline) is shown passing through the indicated section D—D in FIG. 17A. As shown in FIG. 17A, the fourth centerline is parallel to the third centerline and is spaced a predetermined distance (defined above) apart from the third centerline toward the suction valve bore.

Figure 16:
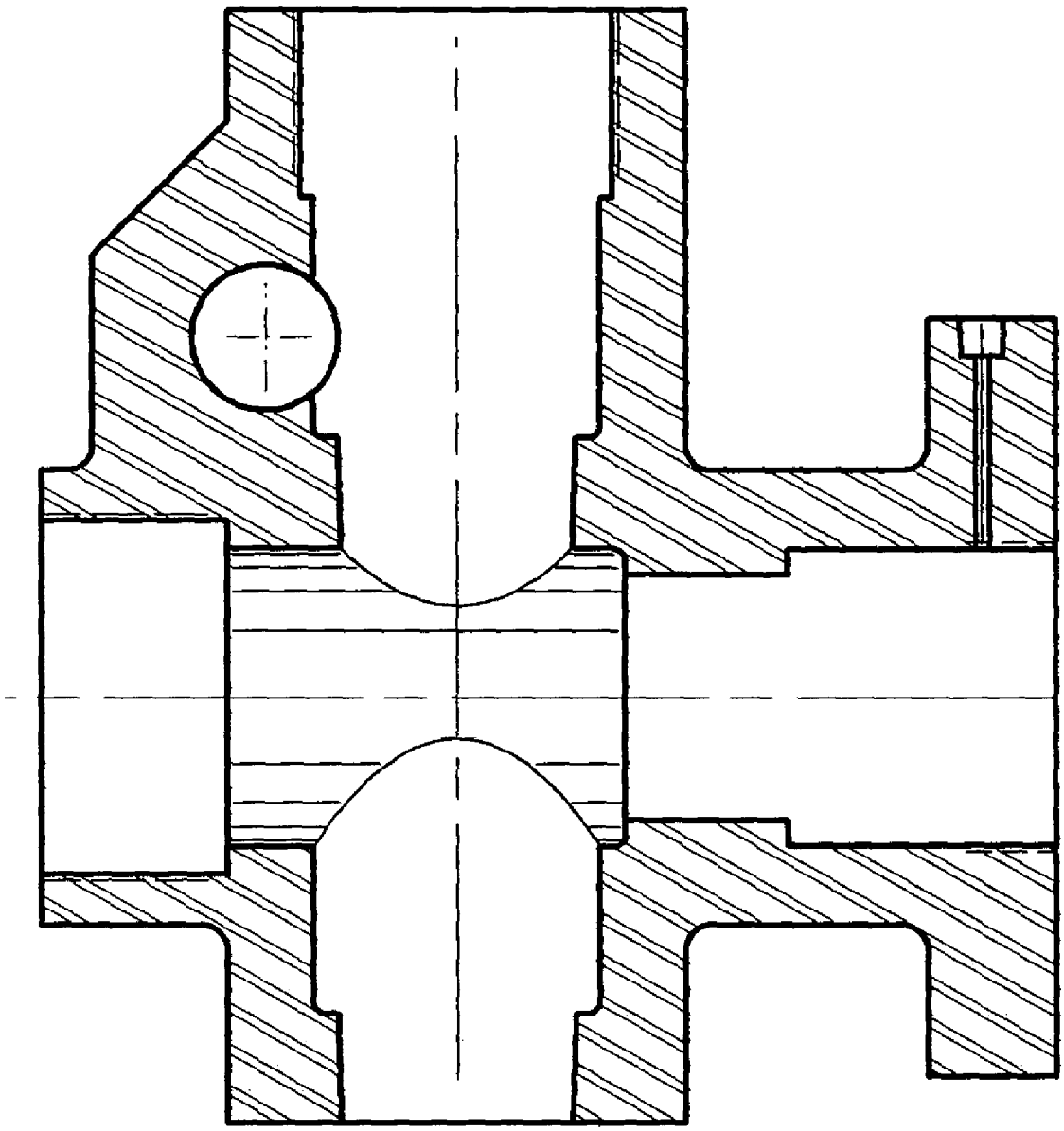
Prior Art Figure 16
FIG. 16 schematically illustrates a typical prior art right-angular plunger pump housing showing the area of largest bore as surrounding the common centerline of the plunger and access bores.

As schematically illustrated, the chamfers 460, 461, 462 and 463 indicate portions of a barrel-shaped space that has been machined from the interior during manufacture of the pump housing 50. For clarification, the profile of this barrel-shaped space (barrel profile) is shown in heavy broken lines on FIG. 17A and discussed further below. Note that this space, which is shown as having a longitudinal axis coincident with the (vertical) centerline (comprising the first and second centerlines) passing through the suction and discharge bores, has transverse cross-sections that are circular, although the respective bore transition areas have oblong transverse cross-sections as shown in FIGS. 17B, 17C, 17D and 17E. Note also that machining the schematically illustrated barrel profile about the vertical centerline (i.e., about the common centerline of the suction and discharge bores), as illustrated in FIG. 17 for the present invention, results in relatively larger (i.e., more beneficial) barrel radii than machining and hand-grinding an analogous (but smaller and cylindrical) profile (as shown in FIG. 16 and labeled as prior art). Note further that a barrel profile of the present invention can alternatively be machined about a horizontal axis (e.g., about the plunger bore centerline) if desired, with similar benefits in stress reduction and weight reduction in a plunger pump housing.

While it is common design practice to call for hand-ground radii at bore intersections, these radii (or chamfers) cannot be made consistent with conventional machining techniques because of limited internal space available for the machine tools. For this reason, the bore intersection chamfers obtained with conventional machine tooling (as in FIG. 16) are generally hand-ground to obtain the desired radii. In contrast, the bore intersection chamfers of the present invention, which are obtained by machining a barrel profile (as in FIG. 17), have more consistent and relatively larger chamfer radii. These larger chamfer radii are associated with surprising dual benefits. As material is removed from chamfer surfaces of a pump housing, stress is shifted from the more-vulnerable bore intersections to less-vulnerable portions of the pump housing. Thus, machining such as that schematically illustrated in FIG. 17 tends to simultaneously make the pump housing both lighter and more resistant to fatigue failure.

These beneficial results are objectively assessed through computer-aided finite element analysis (FEA). FEA provides means to quantify the benefits of, for example, using relatively larger barrel machining radii in the present invention. FEA shows that while use of the larger barrel radii removes relatively more material from the housing, it does not unduly increase stress elsewhere within the housing. In fact, modern computer-based FEA algorithms show that overall pump housing stress can be significantly reduced by the chamfers resulting from machining the relatively large internal barrel profile of the present invention.

This result is surprising because conventional wisdom suggests that removing material from the pump housing would tend to increase stress due to reduced wall thickness, and that removing more material would be associated with further increased housing wall stress. But FEA shows that for chamfers of the present invention the opposite is true. In fact, use of the large barrel profile allows for large chamfers, cut with relatively long radii, that both remove pump housing material and reduce stress in the high stress areas of the housing.

These combined benefits are obtained because the relatively large radii of the barrel machining profile result in removal of material from not only the high-stress bore intersections as noted above, but also the removal of relatively large amounts of material from areas of the pump housing where stress is relatively low. From these latter areas, there is little tendency for significant amounts of stress to be shifted to other parts of the pump housing. Note, however, that use of a large internal barrel machining profile as described above increases the amount of internal pump housing space that is not swept by movement of the plunger. And additional unswept internal pump housing space tends to reduce volumetric efficiency. As described above, this increase in unswept volume is effectively countered through appropriate dimensioning of suction valve spring retainer supports of the present invention to reduce the amount of unswept volume.

What is claimed is:

1. A plunger pump housing with offset access bore, the plunger pump housing comprising:

a suction valve bore having a portion with substantially circular transverse cross-sections for accommodating a circular suction valve, a transition area for facilitating bore interfaces, and a first centerline;

a discharge valve bore having a portion with substantially circular transverse cross-sections for accommodating a circular discharge valve, a transition area for facilitating bore interfaces, and a second centerline, said first and second centerlines being colinear;

a plunger bore having a proximal packing area, a distal transition area for facilitating bore interfaces, and a central area between said packing area and said transition area, said central area having a substantially circular transverse cross-section with a central area diameter and a third centerline, said third centerline being coplanar with said first and second centerlines; and an offset access bore having a cylindrical portion for accommodating an access bore plug and a transition area for facilitating bore interfaces, said cylindrical portion having a fourth centerline, said fourth centerline being coplanar with said first, second and third centerlines and parallel to said third centerline, and said fourth centerline being spaced a predetermined distance apart from said third centerline toward said suction valve bore;

wherein said suction valve bore transition area has elongated transverse cross-sections substantially perpendicular to said first centerline and with a long axis substantially perpendicular to a plane containing said first, second, third and fourth centerlines;

wherein said discharge valve bore transition area has elongated transverse cross-sections substantially perpendicular to said second centerline and with a long axis substantially perpendicular to a plane containing said first, second, third and fourth centerlines;

wherein said plunger bore transition area has elongated transverse cross-sections substantially perpendicular to said third centerline and with a long axis substantially perpendicular to a plane containing said first, second, third and fourth centerlines; and wherein said offset access bore cylindrical portion and said offset access bore transition area have elongated transverse cross-sections substantially perpendicular to said fourth centerline, each said elongated access bore cross-section having a long axis substantially perpendicular to a plane containing said first, second, third and fourth centerlines.

2. The plunger pump housing of claim 1 wherein said second and third centerlines form an angle within a range from approximately 85 degrees to approximately 95 degrees.

3. The plunger pump housing of claim 1 wherein said predetermined distance is between about 2% and about 20% of said central area diameter.

4. The plunger pump housing of claim 1 wherein said plunger bore proximal packing area comprises a tapered portion for accommodating a corresponding tapered cartridge packing assembly.

5. The plunger pump housing of claim 1 wherein each said bore transition area has at least one adjacent chamfer for smoothing bore interfaces.

6. A plunger pump housing with offset access bore, the plunger pump housing comprising:

a suction valve bore having a portion with substantially circular transverse cross-sections for accommodating a circular suction valve, a transition area for facilitating bore interfaces, and a first centerline;

a discharge valve bore having a portion with substantially circular transverse cross-sections for accommodating a circular discharge valve, a transition area for facilitating bore interfaces, and a second centerline, said first and second centerlines being colinear;

a plunger bore having a proximal packing area, a distal transition area for facilitating bore interfaces, and a central area between said packing area and said transition area, said central area having a substantially circular transverse cross-section with a central area diameter and a third centerline, said third centerline being coplanar with said first and second centerlines; and an offset access bore having a cylindrical portion for accommodating an access bore plug and a transition area for facilitating bore interfaces, said cylindrical portion having a fourth centerline, said fourth centerline being coplanar with said first, second and third centerlines and parallel to said third centerline, and said fourth centerline further being spaced a predetermined distance apart from said third centerline toward said suction valve bore;

wherein said suction valve bore transition area has elongated transverse cross-sections substantially perpendicular to said first centerline and with a long axis substantially perpendicular to a plane containing said first, second, third and fourth centerlines;

wherein said discharge valve bore transition area has elongated transverse cross-sections substantially perpendicular to said second centerline and with a long axis substantially perpendicular to a plane containing said first, second, third and fourth centerlines;

wherein said plunger bore transition area has elongated transverse cross-sections substantially perpendicular to said third centerline and with a long axis substantially perpendicular to a plane containing said first, second, third and fourth centerlines;

wherein said offset access bore cylindrical portion and said offset access bore transition area have elongated transverse cross-sections substantially perpendicular to said fourth centerline, each said elongated access bore cross-section having a long axis substantially perpendicular to a plane containing said first, second, third and fourth centerlines.

7. The plunger pump housing of claim 6 wherein said second and third centerlines form an angle within a range from approximately 85 degrees to approximately 95 degrees.

8. The plunger pump housing of claim 6 wherein said predetermined distance is between about 2% and about 20% of said central area diameter.

9. The plunger pump housing of claim 6 wherein said plunger bore proximal packing area comprises a tapered portion for accommodating a corresponding tapered cartridge packing assembly.

10. The plunger pump housing of claim 6 wherein each said bore transition area has at least one adjacent chamfer for smoothing bore interfaces.

11. A plunger pump housing with offset access bore, the plunger pump housing comprising:

a suction valve bore having a portion with substantially circular transverse cross-sections for accommodating a circular suction valve, a transition area for facilitating bore interfaces, and a first centerline;

a discharge valve bore having a portion with substantially circular transverse cross-sections for accommodating a circular discharge valve, a transition area for facilitating bore interfaces, and a second centerline, said first and second centerlines being colinear;

a plunger bore having a proximal packing area, a distal transition area for facilitating bore interfaces, and a central area between said packing area and said transition area, said central area having a substantially circular transverse cross-section with a central area diameter and a third centerline, said third centerline being coplanar with said first and second centerlines; and an offset access bore having a cylindrical portion for accommodating an access bore plug and a transition area for facilitating bore interfaces, said cylindrical portion having a fourth centerline, said fourth centerline being coplanar with said first, second and third centerlines and parallel to said third centerline, and said fourth centerline being spaced a predetermined distance apart from said third centerline toward said suction valve bore;

wherein said suction valve bore transition area has elongated transverse cross-sections substantially perpendicular to said first centerline and with a long axis substantially perpendicular to a plane containing said first, second, third and fourth centerlines;

wherein said discharge valve bore transition area has elongated transverse cross-sections substantially perpendicular to said second centerline and with a long axis substantially perpendicular to a plane containing said first, second, third and fourth centerlines;

wherein said plunger bore transition area has elongated transverse cross-sections substantially perpendicular to said third centerline and with a long axis substantially perpendicular to a plane containing said first, second, third and fourth centerlines;

wherein said offset access bore cylindrical portion and said offset access bore transition area have elongated transverse cross-sections substantially perpendicular to said fourth centerline, each said elongated access bore cross-section having a long axis substantially perpendicular to a plane containing said first, second, third and fourth centerlines;

wherein each said bore transition area has at least one adjacent chamfer for smoothing bore interfaces; and wherein at least one chamfer radius measured perpendicular to said first centerline exceeds all chamfer radii measured perpendicular to said third centerline.

12. The plunger pump housing of claim 11 wherein said second and third centerlines form an angle within a range from approximately 85 degrees to approximately 95 degrees.

13. The plunger pump housing of claim 11 wherein said predetermined distance is between about 2% and about 20% of said central area diameter.

14. The plunger pump housing of claim 11 wherein said plunger bore proximal packing area comprises a tapered portion for accommodating a corresponding tapered cartridge packing assembly.

* * * * *